US009394772B2

(12) United States Patent
Meurer et al.

(10) Patent No.: US 9,394,772 B2
(45) Date of Patent: Jul. 19, 2016

(54) SYSTEMS AND METHODS FOR IN SITU RESISTIVE HEATING OF ORGANIC MATTER IN A SUBTERRANEAN FORMATION

(71) Applicants: William P. Meurer, Magnolia, TX (US); Chen Fang, Houston, TX (US); Federico G. Gallo, Houston, TX (US); Nazish Hoda, Houston, TX (US); Michael W. Lin, Bellaire, TX (US)

(72) Inventors: William P. Meurer, Magnolia, TX (US); Chen Fang, Houston, TX (US); Federico G. Gallo, Houston, TX (US); Nazish Hoda, Houston, TX (US); Michael W. Lin, Bellaire, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 27 days.

(21) Appl. No.: 14/489,113

(22) Filed: Sep. 17, 2014

(65) Prior Publication Data

US 2015/0122491 A1 May 7, 2015

Related U.S. Application Data

(60) Provisional application No. 61/901,234, filed on Nov. 7, 2013.

(51) Int. Cl.
*E21B 43/24* (2006.01)
*E21B 36/04* (2006.01)

(52) U.S. Cl.
CPC ..... *E21B 43/2401* (2013.01); *E21B 36/04* (2013.01)

(58) Field of Classification Search
None
See application file for complete search history.

(56) References Cited

U.S. PATENT DOCUMENTS

| | | | |
|---|---|---|---|
| 363,419 | A | 5/1887 | Poetsch |
| 895,612 | A | 8/1908 | Baker |
| 1,342,780 | A | 6/1920 | Vedder |

(Continued)

FOREIGN PATENT DOCUMENTS

| | | |
|---|---|---|
| CA | 994694 | 8/1976 |
| CA | 1288043 | 8/1991 |

(Continued)

OTHER PUBLICATIONS

M. et al. (2003) "Solution Mining of Nahcolite at the American Soda Project, Piceance Creek, Colorado," *SME Annual Mtg.*, Feb. 24-26, Cincinnati, Ohio, Preprint 03-105.

(Continued)

*Primary Examiner* — Angela M DiTrani
*Assistant Examiner* — Anuradha Ahuja
(74) *Attorney, Agent, or Firm* — ExxonMobil Upstream Research Company Law Dept.

(57) ABSTRACT

A method for pyrolyzing organic matter in a subterranean formation includes powering a first generation in situ resistive heating element within an aggregate electrically conductive zone at least partially in a first region of the subterranean formation by transmitting an electrical current between a first electrode pair in electrical contact with the first generation in situ resistive heating element to pyrolyze a second region of the subterranean formation, adjacent the first region, to expand the aggregate electrically conductive zone into the second region, wherein the expanding creates a second generation in situ resistive heating element within the second region and powering the second generation in situ resistive heating element by transmitting an electrical current between a second electrode pair in electrical contact with the second generation in situ resistive heating element to generate heat with the second generation in situ resistive heating element within the second region.

30 Claims, 9 Drawing Sheets

(56) References Cited

U.S. PATENT DOCUMENTS 1,422,204 A 7/1922 Hoover et al.
1,666,488 A 4/1928 Crawshaw
1,701,884 A 2/1929 Hogle
1,872,906 A 8/1932 Doherty
2,033,560 A 3/1936 Wells
2,033,561 A 3/1936 Wells
2,534,737 A 12/1950 Rose
2,584,605 A 2/1952 Merriam et al.
2,634,961 A 4/1953 Ljungstrom
2,732,195 A 1/1956 Ljungstrom
2,777,679 A 1/1957 Ljungstrom
2,780,450 A 2/1957 Ljungstrom
2,795,279 A * 6/1957 Sarapuu ..... 166/248
2,812,160 A 11/1957 West et al.
2,813,583 A 11/1957 Marx et al.
2,847,071 A 8/1958 De Priester
2,887,160 A 5/1959 De Priester.
2,895,555 A 7/1959 De Priester
2,923,535 A 2/1960 Ljungstrom
2,944,803 A 7/1960 Hanson
2,952,450 A 9/1960 Purre
2,974,937 A 3/1961 Kiel
3,004,601 A 10/1961 Bodine
3,013,609 A 12/1961 Brink
3,095,031 A 6/1963 Eurenius et al.
3,106,244 A 10/1963 Parker
3,109,482 A 11/1963 O'Brien
3,127,936 A 4/1964 Eurenius
3,137,347 A * 6/1964 Parker ..... 166/248
3,149,672 A 9/1964 Orkiszewski et al.
3,170,815 A 2/1965 White
3,180,411 A 4/1965 Parker
3,183,675 A 5/1965 Schroeder
3,183,971 A 5/1965 McEver et al.
3,194,315 A 7/1965 Rogers
3,205,942 A 9/1965 Sandberg
3,225,829 A 12/1965 Chown et al.
3,228,869 A 1/1966 Irish
3,241,611 A 3/1966 Dougan
3,241,615 A 3/1966 Brandt et al.
3,254,721 A 6/1966 Smith et al.
3,256,935 A 6/1966 Nabor et al.
3,263,211 A 7/1966 Heidman
3,267,680 A 8/1966 Schlumberger
3,271,962 A 9/1966 Dahms et al.
3,284,281 A 11/1966 Thomas
3,285,335 A 11/1966 Reistle, Jr.
3,288,648 A 11/1966 Jones
3,294,167 A 12/1966 Vogel
3,295,328 A 1/1967 Bishop
3,323,840 A 6/1967 Mason et al.
3,358,756 A 12/1967 Vogel
3,372,550 A 3/1968 Schroeder
3,376,403 A 4/1968 Mircea
3,382,922 A 5/1968 Needham
3,400,762 A 9/1968 Peacock et al.
3,436,919 A 4/1969 Shock et al.
3,439,744 A 4/1969 Bradley
3,455,392 A 7/1969 Prats
3,461,957 A 8/1969 West
3,468,376 A 9/1969 Slusser et al.
3,494,640 A 2/1970 Coberly et al.
3,500,913 A 3/1970 Nordgren et al.
3,501,201 A 3/1970 Closmann et al.
3,502,372 A 3/1970 Prats
3,513,914 A 5/1970 Vogel
3,515,213 A 6/1970 Prats
3,516,495 A 6/1970 Patton
3,521,709 A 7/1970 Needham
3,528,252 A 9/1970 Gail
3,528,501 A 9/1970 Parker
3,547,193 A 12/1970 Gill
3,559,737 A 2/1971 Ralstin
3,572,838 A 3/1971 Templeton
3,592,263 A 7/1971 Nelson
3,599,714 A 8/1971 Messman et al.
3,602,310 A 8/1971 Halbert
3,613,785 A 10/1971 Closmann et al.
3,620,300 A 11/1971 Crowson
3,642,066 A 2/1972 Gill
3,661,423 A 5/1972 Garrett
3,692,111 A 9/1972 Breithaupt et al.
3,695,354 A 10/1972 Dilgren et al.
3,700,280 A 10/1972 Papadopoulos et al.
3,724,225 A 4/1973 Mancini et al.
3,724,543 A 4/1973 Bell et al.
3,729,965 A 5/1973 Gartner
3,730,270 A 5/1973 Allred
3,739,851 A 6/1973 Beard
3,741,306 A 6/1973 Papadopoulos
3,759,328 A 9/1973 Ueber et al.
3,759,329 A 9/1973 Ross
3,759,574 A 9/1973 Beard
3,779,601 A 12/1973 Beard
3,880,238 A 4/1975 Tham et al.
3,882,937 A 5/1975 Robinson
3,882,941 A 5/1975 Pelofsky
3,888,307 A 6/1975 Closmann
3,924,680 A 12/1975 Terry
3,943,722 A 3/1976 Ross
3,948,319 A 4/1976 Pritchett
3,950,029 A 4/1976 Timmins
3,954,140 A 5/1976 Hendrick
3,958,636 A 5/1976 Perkins
3,967,853 A 7/1976 Closmann et al.
3,978,920 A 9/1976 Bandyopadhyay et al.
3,999,607 A 12/1976 Pennington et al.
4,003,432 A 1/1977 Paull et al.
4,005,750 A 2/1977 Shuck
4,007,786 A 2/1977 Schlinger
4,008,762 A 2/1977 Fisher et al.
4,008,769 A 2/1977 Chang
4,014,575 A 3/1977 French et al.
4,030,549 A 6/1977 Bouck
4,037,655 A 7/1977 Carpenter
4,043,393 A 8/1977 Fisher et al.
4,047,760 A 9/1977 Ridley
4,057,510 A 11/1977 Crouch et al.
4,065,183 A 12/1977 Hill et al.
4,067,390 A 1/1978 Camacho et al.
4,069,868 A 1/1978 Terry
4,071,278 A 1/1978 Carpenter et al.
4,093,025 A 6/1978 Terry
4,096,034 A 6/1978 Anthony
4,125,159 A 11/1978 Vann
4,140,180 A 2/1979 Bridges et al.
4,148,359 A 4/1979 Laumbach et al.
4,149,595 A 4/1979 Cha
4,160,479 A 7/1979 Richardson et al.
4,163,475 A 8/1979 Cha et al.
4,167,291 A 9/1979 Ridley
4,169,506 A 10/1979 Berry
4,185,693 A 1/1980 Crumb et al.
4,186,801 A 2/1980 Madgavkar et al.
4,193,451 A 3/1980 Dauphine
4,202,168 A 5/1980 Acheson et al.
4,239,283 A 12/1980 Ridley
4,241,952 A 12/1980 Ginsburgh
4,246,966 A 1/1981 Stoddard et al.
4,250,230 A 2/1981 Terry
4,265,310 A 5/1981 Britton et al.
4,271,905 A 6/1981 Redford et al.
4,272,127 A 6/1981 Hutchins et al.
4,285,401 A 8/1981 Erickson
RE30,738 E 9/1981 Bridges et al.
4,318,723 A 3/1982 Holmes et al.
4,319,635 A 3/1982 Jones
4,320,801 A 3/1982 Rowland et al.
4,324,291 A 4/1982 Wong et al.
4,340,934 A 7/1982 Segesman
4,344,485 A 8/1982 Butler
4,344,840 A 8/1982 Kunesh
4,353,418 A 10/1982 Hoekstra et al.
4,358,222 A 11/1982 Landau

(56) References Cited

U.S. PATENT DOCUMENTS 4,362,213 A 12/1982 Tabor
4,368,921 A 1/1983 Hutchins
4,369,842 A 1/1983 Cha
4,372,615 A 2/1983 Ricketts
4,375,302 A 3/1983 Kalmar
4,384,614 A 5/1983 Justheim
4,396,211 A 8/1983 McStravick et al.
4,397,502 A 8/1983 Hines
4,401,162 A 8/1983 Osborne
4,412,585 A * 11/1983 Bouck ..... 166/248
4,415,034 A * 11/1983 Bouck ..... 166/302
4,417,449 A 11/1983 Hegarty et al.
4,449,585 A 5/1984 Bridges et al.
4,468,376 A 8/1984 Suggitt
4,470,459 A 9/1984 Copland
4,472,935 A 9/1984 Acheson et al.
4,473,114 A 9/1984 Bell et al.
4,474,238 A 10/1984 Gentry et al.
4,476,926 A 10/1984 Bridges et al.
4,483,398 A 11/1984 Peters et al.
4,485,869 A 12/1984 Sresty et al.
4,487,257 A 12/1984 Dauphine
4,487,260 A 12/1984 Pittman et al.
4,495,056 A 1/1985 Venardos et al.
4,511,382 A 4/1985 Valencia et al.
4,532,991 A 8/1985 Hoekstra et al.
4,533,372 A 8/1985 Valencia et al.
4,537,067 A 8/1985 Sharp et al.
4,545,435 A 10/1985 Bridges et al.
4,546,829 A 10/1985 Martin et al.
4,550,779 A 11/1985 Zakiewicz
4,552,214 A 11/1985 Forgac et al.
4,567,945 A 2/1986 Segalman
4,585,063 A 4/1986 Venardos et al.
4,589,491 A 5/1986 Perkins
4,589,973 A 5/1986 Minden
4,602,144 A 7/1986 Vogel
4,607,488 A 8/1986 Karinthi et al.
4,626,665 A 12/1986 Fort
4,633,948 A 1/1987 Closmann
4,634,315 A 1/1987 Owen et al.
4,637,464 A 1/1987 Forgac et al.
4,640,352 A 2/1987 Vanmeurs et al.
4,671,863 A 6/1987 Tejeda
4,694,907 A 9/1987 Stahl et al.
4,704,514 A 11/1987 Van Egmond et al.
4,705,108 A 11/1987 Little et al.
4,706,751 A 11/1987 Gondouin
4,730,671 A 3/1988 Perkins
4,737,267 A 4/1988 Pao et al.
4,747,642 A 5/1988 Gash et al.
4,754,808 A 7/1988 Harmon et al.
4,776,638 A 10/1988 Hahn
4,779,680 A 10/1988 Sydansk
4,815,790 A 3/1989 Rosar et al.
4,817,711 A 4/1989 Jeambey
4,828,031 A 5/1989 Davis
4,860,544 A 8/1989 Krieg et al.
4,886,118 A 12/1989 Van Meurs et al.
4,923,493 A 5/1990 Valencia et al.
4,926,941 A 5/1990 Glandt et al.
4,928,765 A 5/1990 Nielson
4,929,341 A 5/1990 Thirumalachar et al.
4,954,140 A 9/1990 Kawashima et al.
4,974,425 A 12/1990 Krieg et al.
5,016,709 A 5/1991 Combe et al.
5,036,918 A 8/1991 Jennings et al.
5,050,386 A 9/1991 Krieg et al.
5,051,811 A 9/1991 Williams et al.
5,055,030 A 10/1991 Schirmer
5,055,180 A 10/1991 Klaila
5,082,055 A 1/1992 Hemsath
5,085,276 A 2/1992 Rivas et al.
5,117,908 A 6/1992 Hofmann
5,120,338 A 6/1992 Potts, Jr. et al.
5,217,076 A 6/1993 Masek
5,236,039 A 8/1993 Edelstein et al.
5,255,742 A 10/1993 Mikus
5,275,063 A 1/1994 Steiger et al.
5,277,062 A 1/1994 Blauch et al.
5,297,420 A 3/1994 Gilliland et al.
5,297,626 A 3/1994 Vinegar et al.
5,305,829 A 4/1994 Kumar
5,325,918 A 7/1994 Berryman et al.
5,346,307 A 9/1994 Ramirez et al.
5,372,708 A 12/1994 Gewertz
5,377,756 A 1/1995 Northrop et al.
5,392,854 A 2/1995 Vinegar et al.
5,411,089 A 5/1995 Vinegar et al.
5,416,257 A 5/1995 Peters
5,539,853 A 7/1996 Jamaluddin et al.
5,620,049 A 4/1997 Gipson et al.
5,621,844 A 4/1997 Bridges
5,621,845 A 4/1997 Bridges et al.
5,635,712 A 6/1997 Scott et al.
5,661,977 A 9/1997 Shnell
5,724,805 A 3/1998 Golomb et al.
5,730,550 A 3/1998 Andersland et al.
5,753,010 A 5/1998 Sircar et al.
5,838,634 A 11/1998 Jones et al.
5,844,799 A 12/1998 Joseph et al.
5,868,202 A 2/1999 Hsu
5,899,269 A 5/1999 Wellington et al.
5,905,657 A 5/1999 Celniker
5,907,662 A 5/1999 Buettner et al.
5,938,800 A 8/1999 Verrill et al.
5,956,971 A 9/1999 Cole et al.
6,015,015 A 1/2000 Luft et al.
6,016,867 A 1/2000 Gregoli et al.
6,023,554 A 2/2000 Vinegar et al.
6,055,803 A 5/2000 Mastronarde
6,056,057 A 5/2000 Vinegar et al.
6,079,499 A 6/2000 Mikus et al.
6,112,808 A 9/2000 Isted
6,148,602 A 11/2000 Demetri
6,148,911 A 11/2000 Gipson et al.
6,158,517 A 12/2000 Hsu
6,246,963 B1 6/2001 Cross et al.
6,247,358 B1 6/2001 Dos Santos
6,319,395 B1 11/2001 Kirkbride et al.
6,328,104 B1 12/2001 Graue
6,409,226 B1 6/2002 Slack et al.
6,434,435 B1 8/2002 Tubel et al.
6,434,436 B1 8/2002 Adamy et al.
6,480,790 B1 11/2002 Calvert et al.
6,540,018 B1 4/2003 Vinegar et al.
6,547,956 B1 4/2003 Mukherjee et al.
6,581,684 B2 6/2003 Wellington et al.
6,585,046 B2 7/2003 Neuroth et al.
6,589,303 B1 7/2003 Lokhandwala et al.
6,591,906 B2 7/2003 Wellington et al.
6,607,036 B2 8/2003 Ranson et al.
6,609,735 B1 8/2003 DeLange et al.
6,609,761 B1 8/2003 Ramey et al.
6,659,650 B2 12/2003 Joki et al.
6,659,690 B1 12/2003 Abadi
6,668,922 B2 12/2003 Ziauddin et al.
6,684,644 B2 2/2004 Mittricker et al.
6,684,948 B1 2/2004 Savage
6,708,758 B2 3/2004 de Rouffignac et al.
6,709,573 B2 3/2004 Smith
6,712,136 B2 3/2004 de Rouffignac et al.
6,715,546 B2 4/2004 Vinegar et al.
6,722,429 B2 4/2004 de Rouffignac et al.
6,740,226 B2 5/2004 Mehra et al.
6,742,588 B2 6/2004 Wellington et al.
6,745,831 B2 6/2004 de Rouffignac et al.
6,745,832 B2 6/2004 Wellington et al.
6,745,837 B2 6/2004 Wellington et al.
6,752,210 B2 6/2004 de Rouffignac et al.
6,754,588 B2 6/2004 Cross et al.
6,764,108 B2 7/2004 Ernst et al.
6,782,947 B2 8/2004 de Rouffignac et al.
6,796,139 B2 9/2004 Briley et al.

(56) References Cited

U.S. PATENT DOCUMENTS

| | | | |
|---|---|---|---|
| 6,820,689 | B2 | 11/2004 | Sarada |
| 6,832,485 | B2 | 12/2004 | Surgarmen et al. |
| 6,854,929 | B2 | 2/2005 | Vinegar et al. |
| 6,858,049 | B2 | 2/2005 | Mittricker |
| 6,877,555 | B2 | 4/2005 | Karanikas et al. |
| 6,880,633 | B2 | 4/2005 | Wellington et al. |
| 6,887,369 | B2 | 5/2005 | Moulton et al. |
| 6,896,053 | B2 | 5/2005 | Berchenko et al. |
| 6,896,707 | B2 | 5/2005 | O'Rear et al. |
| 6,913,078 | B2 | 7/2005 | Shahin et al. |
| 6,915,850 | B2 | 7/2005 | Vinegar et al. |
| 6,918,442 | B2 | 7/2005 | Wellington et al. |
| 6,918,443 | B2 | 7/2005 | Wellington et al. |
| 6,918,444 | B2 | 7/2005 | Passey et al. |
| 6,923,257 | B2 | 8/2005 | Wellington et al. |
| 6,923,258 | B2 | 8/2005 | Wellington et al. |
| 6,929,067 | B2 | 8/2005 | Vinegar et al. |
| 6,932,155 | B2 | 8/2005 | Vinegar et al. |
| 6,948,562 | B2 | 9/2005 | Wellington et al. |
| 6,951,247 | B2 | 10/2005 | De Rouffignac et al. |
| 6,953,087 | B2 | 10/2005 | de Rouffignac et al. |
| 6,964,300 | B2 | 11/2005 | Vinegar et al. |
| 6,969,123 | B2 | 11/2005 | Vinegar et al. |
| 6,988,549 | B1 | 1/2006 | Babcock |
| 6,991,032 | B2 | 1/2006 | Berchenko et al. |
| 6,991,033 | B2 | 1/2006 | Wellington et al. |
| 6,994,160 | B2 | 2/2006 | Wellington et al. |
| 6,994,169 | B2 | 2/2006 | Zhang et al. |
| 6,997,518 | B2 | 2/2006 | Vinegar et al. |
| 7,001,519 | B2 | 2/2006 | Linden et al. |
| 7,004,247 | B2 | 2/2006 | Cole et al. |
| 7,004,251 | B2 | 2/2006 | Ward et al. |
| 7,004,985 | B2 | 2/2006 | Wallace et al. |
| 7,011,154 | B2 | 3/2006 | Maher et al. |
| 7,013,972 | B2 | 3/2006 | Vinegar et al. |
| 7,028,543 | B2 | 4/2006 | Hardage et al. |
| 7,032,660 | B2 | 4/2006 | Vinegar et al. |
| 7,036,583 | B2 | 5/2006 | de Rouffignac et al. |
| 7,040,397 | B2 | 5/2006 | Rouffignac et al. |
| 7,040,399 | B2 | 5/2006 | Wellington et al. |
| 7,043,920 | B2 | 5/2006 | Viteri et al. |
| 7,048,051 | B2 | 5/2006 | McQueen |
| 7,051,807 | B2 | 5/2006 | Vinegar et al. |
| 7,051,811 | B2 | 5/2006 | Rouffignac et al. |
| 7,055,600 | B2 | 6/2006 | Messier et al. |
| 7,063,145 | B2 | 6/2006 | Veenstra et al. |
| 7,066,254 | B2 | 6/2006 | Vinegar et al. |
| 7,073,578 | B2 | 7/2006 | Vinegar et al. |
| 7,077,198 | B2 | 7/2006 | Vinegar et al. |
| 7,077,199 | B2 | 7/2006 | Vinegar et al. |
| 7,090,013 | B2 | 8/2006 | Wellington |
| 7,093,655 | B2 | 8/2006 | Atkinson |
| 7,096,942 | B1 | 8/2006 | de Rouffignac et al. |
| 7,096,953 | B2 | 8/2006 | de Rouffignac et al. |
| 7,100,994 | B2 | 9/2006 | Vinegar et al. |
| 7,103,479 | B2 | 9/2006 | Patwardhan et al. |
| 7,104,319 | B2 | 9/2006 | Vinegar et al. |
| 7,121,341 | B2 | 10/2006 | Vinegar et al. |
| 7,121,342 | B2 | 10/2006 | Vinegar et al. |
| 7,124,029 | B2 | 10/2006 | Jammes et al. |
| 7,143,572 | B2 | 12/2006 | Ooka et al. |
| 7,165,615 | B2 | 1/2007 | Vinegar et al. |
| 7,181,380 | B2 | 2/2007 | Dusterhoft et al. |
| 7,198,107 | B2 | 4/2007 | Maguire |
| 7,219,734 | B2 | 5/2007 | Bai et al. |
| 7,225,866 | B2 | 6/2007 | Berchenko et al. |
| 7,243,618 | B2 | 7/2007 | Gurevich |
| 7,255,727 | B2 | 8/2007 | Monereau et al. |
| 7,322,415 | B2 | 1/2008 | de St. Remey |
| 7,331,385 | B2 | 2/2008 | Symington et al. |
| 7,353,872 | B2 | 4/2008 | Sandberg |
| 7,357,180 | B2 | 4/2008 | Vinegar et al. |
| 7,405,243 | B2 | 7/2008 | Lowe et al. |
| 7,441,603 | B2 | 10/2008 | Kaminsky et al. |
| 7,461,691 | B2 | 12/2008 | Vinegar et al. |
| 7,472,748 | B2 | 1/2009 | Gdanski et al. |
| 7,484,561 | B2 | 2/2009 | Bridges |
| 7,516,785 | B2 | 4/2009 | Kaminsky |
| 7,516,786 | B2 | 4/2009 | Dallas et al. |
| 7,516,787 | B2 | 4/2009 | Kaminsky |
| 7,546,873 | B2 | 6/2009 | Kim et al. |
| 7,549,470 | B2 | 6/2009 | Vinegar et al. |
| 7,556,095 | B2 | 7/2009 | Vinegar |
| 7,591,879 | B2 | 9/2009 | Sundaram et al. |
| 7,604,054 | B2 | 10/2009 | Hocking |
| 7,617,869 | B2 | 11/2009 | Carney et al. |
| 7,631,691 | B2 | 12/2009 | Symington et al. |
| 7,637,984 | B2 | 12/2009 | Adamopoulos |
| 7,644,993 | B2 | 1/2010 | Kaminsky et al. |
| 7,647,971 | B2 | 1/2010 | Kaminsky |
| 7,647,972 | B2 | 1/2010 | Kaminsky |
| 7,654,320 | B2 | 2/2010 | Payton |
| 7,669,657 | B2 | 3/2010 | Symington et al. |
| 7,743,826 | B2 | 6/2010 | Harris et al. |
| 7,798,221 | B2 | 9/2010 | Vinegar et al. |
| 7,832,483 | B2 | 11/2010 | Trent |
| 7,857,056 | B2 | 12/2010 | Kaminsky et al. |
| 7,860,377 | B2 | 12/2010 | Vinegar et al. |
| 7,905,288 | B2 | 3/2011 | Kinkead |
| 8,087,460 | B2 | 1/2012 | Kaminsky |
| 8,127,865 | B2 | 3/2012 | Watson et al. |
| 8,176,982 | B2 | 5/2012 | Gil et al. |
| 8,356,935 | B2 | 1/2013 | Arora et al. |
| 8,540,020 | B2 | 9/2013 | Stone et al. |
| 8,596,355 | B2 | 12/2013 | Kaminsky et al. |
| 8,608,249 | B2 | 12/2013 | Vinegar et al. |
| 8,616,280 | B2 | 12/2013 | Kaminsky et al. |
| 8,622,127 | B2 | 1/2014 | Kaminsky |
| 8,662,175 | B2 | 3/2014 | Karanikas et al. |
| 2001/0049342 | A1 | 12/2001 | Passey et al. |
| 2002/0013687 | A1 | 1/2002 | Ortoleva |
| 2002/0023751 | A1 | 2/2002 | Neuroth et al. |
| 2002/0029882 | A1 | 3/2002 | Rouffignac et al. |
| 2002/0049360 | A1 | 4/2002 | Wellington et al. |
| 2002/0056665 | A1 | 5/2002 | Zeuthen et al. |
| 2002/0077515 | A1 | 6/2002 | Wellington et al. |
| 2002/0099504 | A1 | 7/2002 | Cross et al. |
| 2003/0070808 | A1 | 4/2003 | Allison |
| 2003/0080604 | A1 | 5/2003 | Vinegar et al. |
| 2003/0085570 | A1 | 5/2003 | Ernst et al. |
| 2003/0111223 | A1 | 6/2003 | Rouffignac et al. |
| 2003/0131994 | A1 | 7/2003 | Vinegar et al. |
| 2003/0131995 | A1 | 7/2003 | de Rouffignac et al. |
| 2003/0141067 | A1 | 7/2003 | Rouffignac et al. |
| 2003/0178195 | A1 | 9/2003 | Agee et al. |
| 2003/0183390 | A1 | 10/2003 | Veenstra et al. |
| 2003/0192691 | A1 | 10/2003 | Vinegar et al. |
| 2003/0196788 | A1 | 10/2003 | Vinegar et al. |
| 2003/0196789 | A1 | 10/2003 | Wellington |
| 2003/0209348 | A1 | 11/2003 | Ward et al. |
| 2003/0213594 | A1 | 11/2003 | Wellington et al. |
| 2004/0020642 | A1 | 2/2004 | Vinegar et al. |
| 2004/0040715 | A1 | 3/2004 | Wellington et al. |
| 2004/0140095 | A1 | 7/2004 | Vinegar et al. |
| 2004/0198611 | A1 | 10/2004 | Atkinson |
| 2004/0200618 | A1 | 10/2004 | Piekenbrock |
| 2004/0211554 | A1* | 10/2004 | Vinegar et al. ..... 166/60 |
| 2004/0211557 | A1 | 10/2004 | Cole et al. |
| 2005/0051327 | A1 | 3/2005 | Vinegar et al. |
| 2005/0194132 | A1 | 9/2005 | Dudley et al. |
| 2005/0211434 | A1 | 9/2005 | Gates et al. |
| 2005/0211569 | A1 | 9/2005 | Botte et al. |
| 2005/0229491 | A1 | 10/2005 | Loffler |
| 2005/0252656 | A1 | 11/2005 | Maguire |
| 2005/0252832 | A1 | 11/2005 | Doyle et al. |
| 2005/0252833 | A1 | 11/2005 | Doyle et al. |
| 2005/0269077 | A1 | 12/2005 | Sandberg |
| 2005/0269088 | A1 | 12/2005 | Vinegar et al. |
| 2006/0021752 | A1 | 2/2006 | de St. Remey |
| 2006/0100837 | A1 | 5/2006 | Symington et al. |
| 2006/0102345 | A1 | 5/2006 | McCarthy et al. |
| 2006/0106119 | A1 | 5/2006 | Guo et al. |
| 2006/0199987 | A1 | 9/2006 | Kuechler et al. |
| 2006/0213657 | A1 | 9/2006 | Berchenko et al. |

(56) References Cited

U.S. PATENT DOCUMENTS

| | | | | |
|---|---|---|---|---|
| 2007/0000662 | A1 | 1/2007 | Symington et al. | |
| 2007/0023186 | A1 | 2/2007 | Kaminsky et al. | |
| 2007/0045265 | A1 | 3/2007 | McKinzie, II | |
| 2007/0045267 | A1 | 3/2007 | Vinegar et al. | |
| 2007/0084418 | A1 | 4/2007 | Gurevich | |
| 2007/0095537 | A1 | 5/2007 | Vinegar | |
| 2007/0102359 | A1 | 5/2007 | Lombardi et al. | |
| 2007/0131415 | A1 | 6/2007 | Vinegar et al. | |
| 2007/0137869 | A1 | 6/2007 | MacDougall et al. | |
| 2007/0144732 | A1 | 6/2007 | Kim et al. | |
| 2007/0209799 | A1 | 9/2007 | Vinegar et al. | |
| 2007/0215613 | A1* | 9/2007 | Kinzer | 219/764 |
| 2007/0246994 | A1 | 10/2007 | Kaminsky et al. | |
| 2008/0087420 | A1 | 4/2008 | Kaminsky et al. | |
| 2008/0087421 | A1 | 4/2008 | Kaminsky | |
| 2008/0087422 | A1 | 4/2008 | Kobler et al. | |
| 2008/0087426 | A1 | 4/2008 | Kaminsky | |
| 2008/0087427 | A1 | 4/2008 | Kaminsky et al. | |
| 2008/0087428 | A1 | 4/2008 | Symington et al. | |
| 2008/0127632 | A1 | 6/2008 | Finkenrath | |
| 2008/0173442 | A1 | 7/2008 | Vinegar | |
| 2008/0173443 | A1 | 7/2008 | Symington et al. | |
| 2008/0185145 | A1 | 8/2008 | Carney et al. | |
| 2008/0207970 | A1 | 8/2008 | Meurer et al. | |
| 2008/0230219 | A1 | 9/2008 | Kaminsky | |
| 2008/0271885 | A1 | 11/2008 | Kaminsky | |
| 2008/0277317 | A1 | 11/2008 | Touffait et al. | |
| 2008/0283241 | A1 | 11/2008 | Kaminsky et al. | |
| 2008/0289819 | A1 | 11/2008 | Kaminsky et al. | |
| 2008/0290719 | A1 | 11/2008 | Kaminsky et al. | |
| 2008/0314593 | A1 | 12/2008 | Vinegar et al. | |
| 2009/0032251 | A1 | 2/2009 | Cavender et al. | |
| 2009/0038795 | A1 | 2/2009 | Kaminsky et al. | |
| 2009/0050319 | A1 | 2/2009 | Kaminsky et al. | |
| 2009/0101346 | A1 | 4/2009 | Vinegar et al. | |
| 2009/0101348 | A1 | 4/2009 | Kaminsky | |
| 2009/0107679 | A1 | 4/2009 | Kaminsky | |
| 2009/0133935 | A1 | 5/2009 | Kinkead | |
| 2009/0145598 | A1 | 6/2009 | Symington et al. | |
| 2009/0194282 | A1* | 8/2009 | Beer et al. | 166/272.7 |
| 2009/0200290 | A1 | 8/2009 | Cardinal et al. | |
| 2009/0211754 | A1 | 8/2009 | Verret et al. | |
| 2009/0308608 | A1 | 12/2009 | Kaminsky et al. | |
| 2010/0038083 | A1 | 2/2010 | Bicerano | |
| 2010/0078169 | A1 | 4/2010 | Symington et al. | |
| 2010/0089575 | A1 | 4/2010 | Kaminsky et al. | |
| 2010/0089585 | A1 | 4/2010 | Kaminsky | |
| 2010/0095742 | A1 | 4/2010 | Symington et al. | |
| 2010/0101793 | A1* | 4/2010 | Symington et al. | 166/302 |
| 2010/0133143 | A1 | 6/2010 | Roes et al. | |
| 2010/0218946 | A1 | 9/2010 | Symington et al. | |
| 2010/0276983 | A1 | 11/2010 | Dunn et al. | |
| 2010/0282460 | A1 | 11/2010 | Stone et al. | |
| 2010/0307744 | A1 | 12/2010 | Cochet et al. | |
| 2010/0314108 | A1 | 12/2010 | Crews et al. | |
| 2010/0319909 | A1 | 12/2010 | Symington et al. | |
| 2011/0000221 | A1 | 1/2011 | Minta et al. | |
| 2011/0000671 | A1 | 1/2011 | Hershkowitz et al. | |
| 2011/0100873 | A1 | 5/2011 | Viets et al. | |
| 2011/0146981 | A1 | 6/2011 | Diehl | |
| 2011/0146982 | A1 | 6/2011 | Kaminsky et al. | |
| 2011/0186295 | A1 | 8/2011 | Kaminsky et al. | |
| 2011/0257944 | A1 | 10/2011 | Du et al. | |
| 2011/0290490 | A1 | 12/2011 | Kaminsky et al. | |
| 2011/0309834 | A1 | 12/2011 | Homan et al. | |
| 2012/0012302 | A1 | 1/2012 | Vogel et al. | |
| 2012/0267110 | A1 | 10/2012 | Meurer et al. | |
| 2012/0325458 | A1 | 12/2012 | El-Rabaa et al. | |
| 2013/0043029 | A1 | 2/2013 | Vinegar et al. | |
| 2013/0106117 | A1 | 5/2013 | Sites | |
| 2013/0112403 | A1 | 5/2013 | Meurer et al. | |
| 2013/0277045 | A1 | 10/2013 | Parsche | |
| 2013/0292114 | A1 | 11/2013 | Lin et al. | |
| 2013/0292177 | A1 | 11/2013 | Meurer et al. | |
| 2013/0319662 | A1 | 12/2013 | Alvarez et al. | |

FOREIGN PATENT DOCUMENTS

| | | |
|---|---|---|
| CA | 2377467 | 1/2001 |
| CA | 2560223 | 3/2007 |
| EP | 0387846 | 9/1990 |
| EP | 0866212 | 9/1998 |
| GB | 855408 | 11/1960 |
| GB | 1454324 | 11/1976 |
| GB | 1463444 | 2/1977 |
| GB | 1 478 880 | 7/1977 |
| GB | 1501310 | 2/1978 |
| GB | 1559948 | 1/1980 |
| GB | 1595082 | 8/1981 |
| GB | 2430454 | 3/2007 |
| WO | WO 82/01408 | 4/1982 |
| WO | WO 90/06480 | 6/1990 |
| WO | WO 99/67504 | 12/1999 |
| WO | WO 01/78914 | 10/2001 |
| WO | WO 01/81505 | 11/2001 |
| WO | WO 02/085821 | 10/2002 |
| WO | WO 03/035811 | 5/2003 |
| WO | WO 2005/010320 | 2/2005 |
| WO | WO 2005/045192 | 5/2005 |
| WO | WO 2005/091883 | 10/2005 |
| WO | WO 2006/115943 | 11/2006 |
| WO | WO 2007/033371 | 3/2007 |
| WO | WO 2007/050445 | 5/2007 |
| WO | WO 2007/050479 | 5/2007 |
| WO | WO 2010/011402 | 1/2010 |
| WO | WO 2010/047859 | 4/2010 |
| WO | WO 2011/116148 | 9/2011 |
| WO | WO2011/153339 | 12/2011 |
| WO | WO2014/028834 | 2/2014 |

OTHER PUBLICATIONS

Hardy, M., et al. (2003) "Solution Mining of Nahcolite at American Soda's Yankee Gulch Project," *Mining Engineering*, Oct. 2003, pp. 23-31.

Henderson, W, et al. (1968) "Thermal Alteration as a Contributory Process to the Genesis of Petroleum", *Nature* vol. 219, pp. 1012-1016.

Hilbert, L. B. et al, (1999) "Field-Scale and Wellbore Modeling of Compaction-Induced Casing Failures", *SPE Drill. & Completion*, 14(2), June pp. 92-101.

Hill, G.R. et al. (1967) "The Characteristics of a Low Temperature In Situ Shale Oil," *4th Symposium on Oil Shale, Quarterly of the Colorado Schools of Mines*, v.62(3), pp. 641-656.

Hill, G. R. et al. (1967) "Direct Production of a Low Pour Point High Gravity Shale Oil", *I&EC Product Research and Development*, 6(1), March pp. 52-59.

Holditch, S. A., (1989) "Pretreatment Formation Evaluation", *Recent Advances in Hydraulic Fracturing*, SPE Monograph vol. 12, Chapter 2 (Henry L. Doherty Series), pp. 39-56.

Holmes, A. S. et al. (1982) "Process Improves Acid Gas Separation," *Hydrocarbon Processing*, pp. 131-136.

Holmes, A. S. et al. (1983) "Pilot Tests Prove Out Cryogenic Acid-Gas/Hydrocarbon Separation Processes," *Oil & Gas Journal*, pp. 85-86 and 89-91.

Humphrey, J. P. (1978) "Energy from in situ processing of Antrim oil shale", *DOE Report FE-2346-29*.

Ingram, L. L. et al. (1983) "Comparative Study of Oil Shales and Shale Oils from the Mahogany Zone, Green River Formation (USA) and Kerosene Creek Seam, Rundle Formation (Australia)," *Chemical Geology*, 38, pp. 185-212.

Ireson, A. T. (1990) "Review of the Soluble Salt Process for In-Situ Recovery of Hydrocarbons from Oil Shale with Emphasis on Leaching and Possible Beneficiation," *23rd Colorado School of Mines Oil Shale Symposium* (Golden, Colorado), 152-161.

Jacobs, H. R. (1983) "Analysis of the Effectiveness of Steam Retorting of Oil Shale", *AIChE Symposium Series—Heat Transfer*—Seattle 1983 pp. 373-382.

Johnson, D. J. (1966) "Decomposition Studies of Oil Shale," *University of Utah*, May 1966.

(56) References Cited

OTHER PUBLICATIONS

Katz, D.L. et al. (1978) "*Predicting Phase Behavior of Condensate/Crude-Oil Systems Using Methane Interaction Coefficients, J. Petroleum Technology*", pp. 1649-1655.
Kenter, C. J. et al, (2004) "Geomechanics and 4D: Evaluation of Reservoir Characteristics from Timeshifts in the Overburden", *Gulf Rocks 2004, 6th North America Rock Mechanics Symposium (NARMS): Rock Mechanics Across Borders and Disciplines*, Houston, Texas, Jun. 5-9, ARMA/NARMS 04-627.
Kilkelly, M. K., et al. (1981), "Field Studies on Paraho Retorted Oil Shale Lysimeters: Leachate, Vegetation, Moisture, Salinity and Runoff, 1977-1980", prepared for Industrial Environmental Research Laboratory, U. S. Environmental Protection Agency, Cincinnati, OH.
Kuo, M. C. T. et al (1979) "Inorganics leaching of spent shale from modified in situ processing," J. H. Gary (ed.) *Twelfth Oil Shale Symposium Proceedings*, Colorado School of Mines, Golden CO., Apr. 18-20, pp. 81-93.
Laughrey, C. D. et al. (2003) "Some Applications of Isotope Geochemistry for Determining Sources of Stray Carbon Dioxide Gas," *Environmental Geosciences*, 10(3), pp. 107-122.
Lekas, M. A. et al. (1991) "Initial evaluation of fracturing oil shale with propellants for in situ retorting—Phase 2", *DOE Report DOE/MC/11076-3064*.
Le Pourhiet, L. et al, (2003) "Initial Crustal Thickness Geometry Controls on the Extension in a Back Arc Domain: Case of the Gulf of Corinth", *Tectonics*, vol. 22, No. 4, pp. 6-1-6-14.
Lundquist, L. (1951) "Refining of Swedish Shale Oil", *Oil Shale Cannel Coal Conference*, vol./Issue: 2, pp. 621-627.
Marotta, A. M. et al, (2003) "Numerical Models of Tectonic Deformation at the Baltica-Avalonia Transition Zone During the Paleocene Phase of Inversion", *Tectonophysics*, 373, pp. 25-37.
Miknis, F.P, et al (1985) "Isothermal Decomposition of Colorado Oil Shale", DOE/FE/60177-2288 (DE87009043) May 1985.
Mohammed, Y.A., et al (2001) "A Mathematical Algorithm for Modeling Geomechanical Rock Properties of the Khuff and PreKhuff Reservoirs in Ghawar Field", *Society of Petroleum Engineers* SPE 68194, pp. 1-8.
Molenaar, M. M. et al, (2004) "Applying Geo-Mechanics and 4D: '4D In-Situ Stress' as a Complementary Tool for Optimizing Field Management", *Gulf Rocks 2004, 6th North America Rock Mechanics Symposium (NARMS): Rock Mechanics Across Borders and Disciplines*, Houston, Texas, Jun. 5-9, ARMA/NARMS 04-639, pp. 1-8.
Moschovidis, Z. (1989) "Interwell Communication by Concurrent Fracturing—a New Stimulation Technique", *Journ. of Canadian Petro. Tech*. 28(5), pp. 42-48.
Motzfeldt, K. (1954) "The Thermal Decomposition of Sodium Carbonate by the Effusion Method," *Jrnl. Phys. Chem*., v. LIX, pp. 139-147.
Mut, Stephen (2005) "The Potential of Oil Shale," *Shell Oil Presentation at National Academies, Trends in Oil Supply Demand*, in Washington, DC, Oct. 20-21, 2005, 11 pages.
Needham, et al (1976) "Oil Yield and Quality from Simulated In-Situ Retorting of Green River Oil Shale", Society of Petroleum Engineers of American Institute of Mining, Metallurgical and Petroleum Engineers, Inc. SPE 6069.
Newkirk, A. E. et al. (1958) "Drying and Decomposition of Sodium Carbonate," *Anal. Chem*., 30(5), pp. 982-984.
Nielsen, K. R., (1995) "Colorado Nahcolite: A Low Cost Source of Sodium Chemicals," *7th Annual Canadian Conference on Markets for Industrial Minerals*, (Vancouver, Canada, Oct. 17-18) pp. 1-9.
Nordin, J. S, et al. (1988), "Groundwater studies at Rio Blanco Oil Shale Company's retort 1 at Tract C-a", DOE/MC/11076-2458.
Nottenburg, R.N. et al. (1979) "Temperature and stress dependence of electrical and mechanical properties of Green River oil shale," *Fuel*, 58, pp. 144-148.
Nowacki, P. (ed.), (1981) *Oil Shale Technical Handbook*, Noyes Data Corp. pp. 4-23, 80-83 & 160-183.
Pattillo, P. D. et al, (1998) "Reservoir Compaction and Seafloor Subsidence at Valhall", SPE 47274, 1998, pp. 377-386.
Pattillo, P. D. et al, (2002) "Analysis of Horizontal Casing Integrity in the Valhall Field", SPE 78204, pp. 1-10.
Persoff, P. et al. (1979) "Control strategies for abandoned in situ oil shale retorts," J. H. Gary (ed.), *12th Oil Shale Symposium Proceedings*, Colorado School of Mines, Golden, CO., Apr. 18-20, pp. 72-80.
Peters, G., (1990) "The Beneficiation of Oil Shale by the Solution Mining of Nahcolite," *23rd Colorado School of Mines Oil Shale Symposium* (Golden, CO) pp. 142-151.
Pope, M.I. et al. (1961) "The specific electrical conductivity of coals," Fuel, vol. 40, pp. 123-129.
Plischke, B., (1994) "Finite Element Analysis of Compaction and Subsidence—Experience Gained from Several Chalk Fields", *Society of Petroleum Engineers*, SPE 28129, 1994, pp. 795-802.
Poulson, R. E., et al. (1985), "Organic Solute Profile of Water from Rio Blanco Retort 1", DOE/FE/60177-2366.
Prats, M. et al. (1975) "The Thermal Conductivity and Diffusivity of Green River Oil Shales", *Journal of Petroleum Technology*, pp. 97-106, Jan. 1975.
Prats, M., et al. (1977) "Soluble-Salt Processes for In-Situ Recovery of Hydrocarbons from Oil Shale," *Journal of Petrol. Technol.*, pp. 1078-1088.
Rajeshwar, K. et al. (1979) "Review: Thermophysical Properties of Oil Shales", *Journal of Materials Science*, v.14, pp. 2025-2052.
Ali, A.H.A, et al, (2003) "Watching Rocks Change-Mechanical Earth Modeling", *Oilfield Review*, pp. 22-39.
Allred, (1964) "Some Characteristic Properties of Colorado Oil Shale Which May Influence In Situ Processing," *Quarterly Colo. School of Mines, 1st Symposium Oil Shale*, v.59. No. 3, pp. 47-75.
Anderson, R., et al (2003) "Power Generation with 100% Carbon Capture Sequestration" 2nd Annual Conference on Carbon Sequestration, Alexandria, VA.
Asquith, G., et al., (2004) *Basic Well Log Analysis*, Second Ed., Chapter 1, pp. 1-20.
Ball, J.S., et al. (1949) "Composition of Colorado Shale-Oil Naphtha", *Industrial and Engineering Chemistry*, vol. 41, No. 3 pp. 581-587.
Barnes, A. L. et al. (1968) "A Look at in Situ Oil Shale Retorting Methods Based on Limited Heat Transfer Contact Surfaces" Quarterly of the Colorado School of Mines *Fifth Symposium on Oil Shale*, v. 63(4), Oct. 1968, pp. 827-852.
Bastow, T.P., (1998) Sedimentary Processes Involving Aromatic Hydrocarbons >>. Thesis (PhD in Applied Chemistry) Curtin University of Technology (Australia), December, p. 1-92.
Baughman, G. L. (1978) *Synthetic Fuels Data Handbook*, Second Edition, Cameron Engineers Inc. pp. 3-145.
Berry, K. L., et al. (1982) "Modified in situ retorting results of two field retorts", Gary, J. H., ed., 15th Oil Shale Symp., CSM, pp. 385-396.
Blanton, T. L. et al, (1999) "Stress Magnitudes from Logs: Effects of Tectonic Strains and Temperature", *SPE Reservoir Eval. & Eng. 2*, vol. 1, February, pp. 62-68.
Bondarenko, S.T., et al., (1959) "Application of electrical current for direct action on a seam of fuel in shaftless underground gasification," Academy of Sciences of the USSR, Translated for Lawrence Livermore Laboratory by Addis Translations International in Mar. 1976, pp. 25-41.
Boyer, H. E. et al. (1985) "Chapter 16: Heat-Resistant Materials," *Metals Handbook*, American Society for Metals, pp. 16-1-16-26.
Brandt, A. R., (2008) "*Converting Oil Shale to Liquid Fuels: Energy Inputs and Greenhouse Gas Emissions of the Shell in Situ Conversion Process*," Environ. Sci. Technol. 2008, 42, pp. 7489-7495.
Brandt, H. et al. (1965) "Stimulating Heavy Oil Reservoirs With Downhole Air-Gas Burners," *World Oil*, (Sep. 1965), pp. 91-95.
Braun, R.L. et al. (1990) "Mathematical model of oil generation, degradation, and expulsion," Energy Fuels, vol. 4, No. 2, pp. 132-146.
Bridges, J. E., et al. (1983) "The IITRI in situ fuel recovery process", *J. Microwave Power*, v. 18, pp. 3-14.
Bridges, J.E., (2007) "Wind Power Energy Storage for in Situ Shale Oil Recovery With Minimal CO2 Emissions", IEEE Transactions on Energy Conversion, vol. 22, No. 1 Mar. 2007, pp. 103-109.
Burnham, A.K. (1979) "Reaction kinetics between CO2 and oil-shale residual carbon 1. Effect of heating rate on reactivity," Fuel, vol. 58, pp. 285-292.

(56) References Cited

OTHER PUBLICATIONS

Burnham, A. K. et al. (1983) "High-Pressure Pyrolysis of Green River Oil Shale" in Geochemistry and Chemistry of Oil Shales: ACS Symposium Series, pp. 335-351.
Burwell, E. L. et al. (1970) "Shale Oil Recovery by In-Situ Retorting—A Pilot Study" Journal of Petroleum Engr., Dec. 1970, pp. 1520-1524.
Campbell, J.H. (1978) "The Kinetics of decomposition of Colorado oil shale II. Carbonate minerals," Lawrence Livermore Laboratory UCRL-52089.
Charlier, R. et al, (2002) "Numerical Simulation of the Coupled Behavior of Faults During the Depletion of a High-Pressure/High-Temperature Reservoir", *Society of Petroleum Engineers*, SPE 78199, pp. 1-12.
Chute, F. S., and Vermeulen, F. E., (1988) "Present and potential applications of electromagnetic heating in the In-Situ recovery of oil", AOSTRA J. Res., v. 4, pp. 19-33.
Chute, F. S. and Vermeulen, F.E., (1989) "Electrical heating of reservoirs", Hepler, L., and Hsi, C., eds., AOSTRA Technical Handbook on Oil Sands, Bitumens, and Heavy Oils, Chapt. 13, pp. 339-376.
Cipolla, C.L., et al. (1994), "Practical Application of in-situ Stress Profiles", *Society of Petroleum Engineers*, SPE 28607, pp. 487-499.
Cook, G. L. et al. (1968) "The Composition of Green River Shale Oils" United Nations Symposium of the Development and Utilization of Oil Shale Resources, pp. 3-23.
Covell, J. R., et al. (1984) "Indirect in situ retorting of oil shale using the TREE process", Gary, J. H., ed., 17th Oil Shale Symposium Proceedings, Colorado School of Mines, pp. 46-58.
Cummins, J. J. et al. (1972) Thermal Degradation of Green River Kerogen at 150 to 350C: Rate of Product Formation, Report of Investigation 7620, *US Bureau of Mines*, 1972, pp. 1-15.
Day, R. L., (1998) "Solution Mining of Colorado Nahcolite," Wyoming State Geological Survey Public Information Circular 40, *Proceedings of the First International Soda Ash Conference*, V.II (Rock Springs, Wyoming, Jun. 10-12) pp. 121-130.
DePriester, C. et al. (1963) "Well Stimulation by Downhole Gas-Air Burner," *Jml. Petro. Tech.*, (Dec. 1963), pp. 1297-1302.
Domine, F. et al. (2002) "Up to What Temperature is Petroleum Stable? New Insights from a 5200 Free Radical Reactions Model", *Organic Chemistry*, 33, pp. 1487-1499.
Dougan, P. M. et al. (1981) "BX in Situ Oil Shale Project," *Colorado School of Mines; Fourteenth Oil Shale Symposium Proceedings*, 1981, pp. 118-127.
Dougan, P. M. (1979) "The Bx in Situ Oil Shale Project," *Chem. Engr. Progress*, pp. 81-84.
Duba, A.G. (1977) "Electrical conductivity of coal and coal char," Fuel, vol. 56, pp. 441-443.
Duba, A. (1983) "Electrical conductivity of Colorado oil shale to 900C," Fuel, vol. 62, pp. 966-972.
Duncan, D. C., (1967) "Geologic Setting of Oil Shale Deposits and World Prospects," *in Proceedings of the Seventh World Petroleum Congress*, v.3, Elsevier Publishing, pp. 659-667.
Dunks, G. et al. (1983) "Electrochemical Studies of Molten Sodium Carbonate," *Inorg. Chem.*, 22, pp. 2168-2177.
Dusseault, M.B. (1998) "Casing Shear: Causes, Cases, Cures", Society of Petroleum Engineers, SPE 48,864 pp. 337-349.
Dyni, J. R., (1974) "Stratigraphy and Nahcolite Resources of the Saline Facies of the Green River Formation in Northwest Colorado," in D.K. Murray (ed.), *Guidebook to the Energy Resources of the Piceance Creek Basin Colorado, Rocky Mountain Association of Geologists*, Guidebook, pp. 111-122.
Fainberg, V. et al. (1998) "Integrated Oil Shale Processing Into Energy and Chemicals Using Combined-Cycle Technology," *Energy Sources*, v.20.6, pp. 465-481.
Farouq Ali, S. M., (1994), "Redeeming features of in situ combustion", DOE/NIPER *Symposium on In Situ Combustion Practices-Past, Present, and Future Application*, Tulsa, OK, Apr. 21-22, No. ISC 1, p. 3-8.
Fisher, S. T. (1980) "A Comparison of Eleven Processes for Production of Energy from the Solid Fossil Fuels of North America," *SPE* 9098, pp. 1-27.
Fox, J. P., et al. (1979) "Partitioning of major, minor, and trace elements during simulated in situ oil shale retorting in a controlled-state retort", Twelfth Oil Shale Symposium Proceedings, Colorado School of Mines, Golden Colorado, Apr. 18-20, 1979.
Fox, J. P, (1980) "Water Quality Effects of LeachatesFrom an In-Situ Oil Shale Industry," *California Univ., Berkeley, Lawrence Berkeley Lab*, Chapters 6-7.
Fredrich, J. T. et al, (1996) "Three-Dimensional Geomechanical Simulation of Reservoir Compaction and Implications for Well Failures in the Belridge Diatomite", *Society of Petroleum Engineers* SPE 36698, pp. 195-210.
Fredrich, J. T. et al, (2000) "Geomechanical Modeling of Reservoir Compaction, Surface Subsidence, and Casing Damage at the Belridge Diatomite Field", *SPE Reservoir Eval. & Eng.3*, vol. 4, August, pp. 348-359.
Fredrich, J. T. et al, (2003) "Stress Perturbations Adjacent to Salt Bodies in the Deepwater Gulf of Mexico", *Society of Petroleum Engineers* SPE 84554, pp. 1-14.
Frederiksen, S. et al, (2000) "A Numerical Dynamic Model for the Norwegian-Danish Basin", *Tectonophysics*, 343, 2001, pp. 165-183.
Freund, H. et al., (1989) "Low-Temperature Pyrolysis of Green River Kerogen", *The American Association of Petroleum Geologists Bulletin*, v. 73, No. 8 (August) pp. 1011-1017.
Gatens III, J. M. et al, (1990) "In-Situ Stress Tests and Acoustic Logs Determine Mechanical Properties and Stress Profiles in the Devonian Shales", *SPE Formation Evaluation* SPE 18523, pp. 248-254.
Garland, T. R., et al. (1979) "Influence of irrigation and weathering reactions on the composition of percolates from retorted oil shale in field lysimeters", Twelfth Oil Shale Symposium Proceedings, Colorado School of Mines, Golden Colorado, Apr. 18-20, 1979, pp. 52-57.
Garthoffner, E. H., (1998), "Combustion front and burned zone growth in successful California ISC projects", SPE 46244.
Greaves, M., et al. (1994) "In situ combustion (ISC) processes: 3D studies of vertical and horizontal wells", *Europe Comm. Heavy Oil Technology in a Wider Europe Symposium*, Berlin, Jun. 7-8, p. 89-112.
Hansen, K. S. et al, (1989) "Earth Stress Measurements in the South Belridge Oil Field, Kern County, California", *SPE Formation Evaluation*, December pp. 541-549.
Hansen, K. S. et al, (1993) "Finite-Element Modeling of Depletion-Induced Reservoir Compaction and Surface Subsidence in the South Belridge Oil Field, California", SPE 26074, pp. 437-452.
Hansen, K. S. et al, (1995) "Modeling of Reservoir Compaction and Surface Subsidence at South Belridge", *SPE Production & Facilities*, August pp. 134-143.
Ramey, M. et al. (2004) "The History and Performance of Vertical Well Solution Mining of Nahcolite ($NaHCO_3$) in the Piceance Basin, Northwestern, Colorado, USA," *Solution Mining Research Institute: Fall 2004 Technical Meeting* (Berlin, Germany).
Reade Advanced Materials; 2006 About.com Electrical resistivity of materials. [Retrieved on Oct. 15, 2009] Retrieved from internet: URL: http://www.reade.com/Particle%5FBriefings/elec%5Fres.html. Entire Document.
Rio Blanco Oil Shale Company, (1986), "MIS Retort Abandonment Program" Jun. 1986 Pumpdown Operation.
Riva, D. et al. (1998) "Suncor down under: the Stuart Oil Shale Project", Annual Meeting of the *Canadian Inst. Of Mining, Metallurgy, and Petroleum*, Montreal, May 3-7.
Robson, S. G. et al., (1981), "Hydrogeochemistry and simulated solute transport, Piceance Basin, northwestern Colorado", U. S. G. S. Prof. Paper 1196.
Rupprecht, R. (1979) "Application of the Ground-Freezing Method to Penetrate a Sequence of Water-Bearing and Dry Formations—Three Construction Cases," Engineering Geology, 13, pp. 541-546.
Ruzicka, D.J. et al. (1987) "Modified Method Measures Bromine Number of Heavy Fuel Oils", *Oil & Gas Journal*, 85(31), Aug. 3, pp. 48-50.
Salamonsson, G. (1951) "The Ljungstrom in Situ Method for Shale-Oil Recovery," 2nd *Oil Shale and Cannel Coal Conference*, 2, Glasgow, Scotland, Inst. of Petrol., London, pp. 260-280.

(56) References Cited

OTHER PUBLICATIONS

Sahu, D. et al. (1988) "Effect of Benzene and Thiophene on Rate of Coke Formation During Naphtha Pyrolysis", *Canadian Journ. of Chem. Eng.*, 66, Oct. pp. 808-816.
Sandberg, C. R. et al. (1962) "In-Situ Recovery of Oil from Oil Shale—A Review and Summary of Field and Laboratory Studies," RR62.039FR, Nov. 1962.
Sierra, R. et al. (2001) "Promising Progress in Field Application of Reservoir Electrical Heating Methods," SPE 69709, SPE Int'l Thermal Operations and Heavy Oil Symposium, Venezuela, Mar. 2001.
Siskin, M. et al. (1995) "Detailed Structural Characterization of the Organic Material in Rundel Ramsay Crossing and Green River Oil Shales," *Kluwer Academic Publishers*, pp. 143-158.
Smart, K. J. et al, (2004) "Integrated Structural Analysis and Geomechanical Modeling: an Aid to Reservoir Exploration and Development", *Gulf Rocks 2004, 6th North America Rock Mechanics Symposium (NARMS): Rock Mechanics Across Borders and Disciplines*, Houston, Texas, Jun. 5-9, ARMA/NARMS 04-470.
Smith, F. M. (1966) "A Down-hole Burner—Versatile Tool for Well Heating," *25th Tech. Conf. on Petroleum Production*, Pennsylvania State Univ., pp. 275-285.
Sresty, G. C.; et al. (1982) "Kinetics of Low-Temperature Pyrolysis of Oil Shale by the IITRI RF Process," *Colorado School of Mines; Fifteenth Oil Shale Symposium Proceedings*, Aug. 1982, pp. 411-423.
Stanford University, (2008) "Transformation of Resources to Reserves: Next Generation Heavy-Oil Recovery Techniques", Prepared for U.S. Department of Energy, National Energy Technology Laboratory, DOE Award No. DE-FC26-04NT15526, Mar. 28, 2008.
Stevens, A. L., and Zahradnik, R. L. (1983) "Results from the simultaneous processing of modified in situ retorts 7& 8", Gary, J. H., ed., *16th Oil Shale Symp.*, CSM, p. 267-280.
Stoss, K. et al. (1979) "Uses and Limitations of Ground Freezing With Liquid Nitrogen," *Engineering Geology*, 13, pp. 485-494.
Symington, W.A., et al (2006) "ExxonMobil's electrofrac process for in situ oil shale conversion," 26th Oil Shale Symposium, Colorado School of Mines.
Syunyaev, Z.I. et al. (1965) "Change in the Resistivity of Petroleum Coke on Calcination," Chemistry and Technology of Fuels and Oils, 1(4), pp. 292-295.
Taylor, O. J., (1987), "Oil Shale, Water Resources and Valuable Minerals of the Piceance Basin, Colorado: The Challenge and Choices of Development". U. S. Geol. Survey Prof. Paper 1310, pp. 63-76.
Templeton, C. C. (1978) "Pressure-Temperature Relationship for Decomposition of Sodium Bicarbonate from 200 to 600° F," *J. of Chem. and Eng. Data*, 23(1), pp. 7-8.
Thomas, A. M. (1963) "Thermal Decomposition of Sodium Carbonate Solutions," *J. of Chem. and Eng. Data*, 8(1), pp. 51-54.
Thomas, G. W. (1964) "A Simplified Model of Conduction Heating in Systems of Limited Permeability," *Soc.Pet. Engineering Journal*, Dec. 1964, pp. 335-344.
Thomas, G. W. (1966) "Some Effects of Overburden Pressure on Oil Shale During Underground Retorting," *Society of Petroleum Engineers Journal*, pp. 1-8, Mar. 1966.
Tihen, S. S. Et al. (1967) "Thermal Conductivity and Thermal Diffusivity of Green River Oil Shale," *Thermal Conductivity: Proceedings of the Seventh Conference* (Nov. 13-16, 1967), *NBS Special Publication* 302, pp. 529-535, 1968.
Tisot, P. R. et al. (1970) "Structural Response of Rich Green River Oil Shales to Heat and Stress and Its Relationship to Induced Permeability," *Journal of Chemical Engineering Data*, v. 15(3), pp. 425-434.
Tisot, P. R. et al. (1971) "Structural Deformation of Green River Oil Shale as It Relates to In Situ Retorting," *US Bureau of Mines Report of Investigations 7576*, 1971.
Tisot, P. R. (1975) "Structural Response of Propped Fractures in Green River Oil Shale as It Relates to Underground Retorting," *US Bureau of Mines Report of Investigations 8021*.
Tissot, B. P., and Welte, D. H. (1984) *Petroleum Formation and Occurrence*, New York, Springer-Verlag, p. 160-198 and 254-266.
Tissot, B. P., and Welte, D. H. (1984) *Petroleum Formation and Occurrence*, New York, Springer-Verlag, p. 267-289 and 470-492.
Turta, A., (1994), "In situ combustion-from pilot to commercial application", *DOE/NIPER Symposium on In Situ Combustion Practices-Past, Present, and Future Application*, Tulsa, OK, Apr. 21-22, No. ISC 3, p. 15-39.
Tyner, C. E. et al. (1982) "Sandia/Geokinetics Retort 23: a horizontal in situ retorting experiment", Gary, J. H., ed., *15th Oil Shale Symp.*, CSM, p. 370-384.
Tzanco, E. T., et al. (1990), "Laboratory Combustion Behavior of Countess B Light Oil", *Petroleum Soc. of CIM and SPE*, Calgary, Jun. 10-13, No. CIM/SPE 90-63, p. 63.1-63.16.
Veatch, Jr. R.W. and Martinez, S.J., et al. (1990) "Hydraulic Fracturing: SPE Reprint Series No. 28", *Soc. of Petroleum Engineers* SPE 14085, Part I, Overview, pp. 12-44.
Vermeulen, F.E., et al. (1983) "Electromagnetic Techniques in the In-Situ Recovery of Heavy Oils", Journal of Microwave Power, 18(1) pp. 15-29.
Warpinski, N.R., (1989) "Elastic and Viscoelastic Calculations of Stresses in Sedimentary Basins", *SPE Formation Evaluation*, vol. 4, pp. 522-530.
Yen, T. F. et al. (1976) *Oil Shale*, Amsterdam, Elsevier, p. 215-267.
Yoon, E. et al. (1996) "High-Temperature Stabilizers for Jet Fuels and Similar Hydrocarbon Mixtures. 1. Comparative Studies of Hydrogen Donors", *Energy & Fuels*, 10, pp. 806-811.
Oil & Gas Journal, 1998, "Aussie oil shale project moves to Stage 2", Oct. 26, p. 42.
"Encyclopedia of Chemical Technology" (4th ed.), *Alkali and Chlorine Products*, pp. 1025-1039 (1998).

* cited by examiner

SYSTEMS AND METHODS FOR IN SITU RESISTIVE HEATING OF ORGANIC MATTER IN A SUBTERRANEAN FORMATION

CROSS-REFERENCE TO RELATED APPLICATION

This application claims the priority benefit of U.S. Provisional Patent Application 61/901,234 filed Nov. 7, 2013 entitled SYSTEMS AND METHODS FOR IN SITU RESISTIVE HEATING OF ORGANIC MATTER IN A SUBTERRANEAN FORMATION, the entirety of which is incorporated by reference herein.

FIELD

The present disclosure is directed generally to systems and methods for in situ resistive heating of organic matter in a subterranean formation, and more particularly to systems and methods for controlling the growth of in situ resistive heating elements in the subterranean formation.

BACKGROUND

Certain subterranean formations may include organic matter, such as shale oil, bitumen, and/or kerogen, which have material and chemical properties that may complicate production of fluid hydrocarbons from the subterranean formation. For example, the organic matter may not flow at a rate sufficient for production. Moreover, the organic matter may not include sufficient quantities of desired chemical compositions (typically smaller hydrocarbons). Hence, recovery of useful hydrocarbons from such subterranean formations may be uneconomical or impractical.

Generally, organic matter is subject to decompose upon exposure to heat over a period of time, via a process called pyrolysis. Upon pyrolysis, organic matter, such as kerogen, may decompose chemically to produce hydrocarbon oil, hydrocarbon gas, and carbonaceous residue (the residue may be referred to generally as coke). Coke formed by pyrolysis typically has a richer carbon content than the source organic matter from which it was formed. Small amounts of water also may be generated via the pyrolysis reaction. The oil, gas, and water fluids may become mobile within the rock or other subterranean matrix, while the residue coke remains essentially immobile.

One method of heating and causing pyrolysis includes using electrically resistive heaters, such as wellbore heaters, placed within the subterranean formation. However, electrically resistive heaters have a limited heating range. Though heating may occur by radiation and/or conduction to heat materials far from the well, to do so, a heater typically will heat the region near the well to very high temperatures for very long times. In essence, conventional methods for heating regions of a subterranean formation far from a well may involve overheating the nearby material in an attempt to heat the distant material. Such uneven application of heat may result in suboptimal production from the subterranean formation. Additionally, using wellbore heaters in a dense array to mitigate the limited heating distance may be cumbersome and expensive. Thus, there exists a need for more economical and efficient heating of subterranean organic matter to pyrolyze the organic matter.

SUMMARY

The present disclosure provides systems and methods for in situ resistive heating of organic matter in a subterranean formation to enhance hydrocarbon production.

A method for pyrolyzing organic matter in a subterranean formation may comprise powering a first generation in situ resistive heating element within an aggregate electrically conductive zone at least partially in a first region of the subterranean formation by transmitting an electrical current between a first electrode pair in electrical contact with the first generation in situ resistive heating element to pyrolyze a second region of the subterranean formation, adjacent the first region, to expand the aggregate electrically conductive zone into the second region, wherein the expanding creates a second generation in situ resistive heating element within the second region and powering the second generation in situ resistive heating element by transmitting an electrical current between a second electrode pair in electrical contact with the second generation in situ resistive heating element to generate heat with the second generation in situ resistive heating element within the second region, wherein at least one electrode of the second electrode pair extends within the second region.

A method for pyrolyzing organic matter in a subterranean formation may comprise transmitting a first electrical current in the subterranean formation between a first electrode pair in electrical contact with a first generation in situ resistive heating element, powering a first generation in situ resistive heating element, within an aggregate electrically conductive zone at least partially in a first region of the subterranean formation, with the first electrical current, and expanding the aggregate electrically conductive zone into a second region, adjacent the first region of the subterranean formation, with the first electrical current. The expanding may create a second generation in situ resistive heating element within the second region. The method further may comprise transmitting a second electrical current in the subterranean formation between a second electrode pair in electrical contact with the second generation in situ resistive heating element, powering the second generation in situ resistive heating element with the second electrical current, and generating heat with the second generation in situ resistive heating element within the second region, wherein at least one electrode of the second electrode pair extends within the second region.

The foregoing has broadly outlined the features of the present disclosure so that the detailed description that follows may be better understood. Additional features will also be described herein.

BRIEF DESCRIPTION OF THE DRAWINGS

These and other features, aspects and advantages of the disclosure will become apparent from the following description, appending claims and the accompanying drawings, which are briefly described below.

Figure 1:
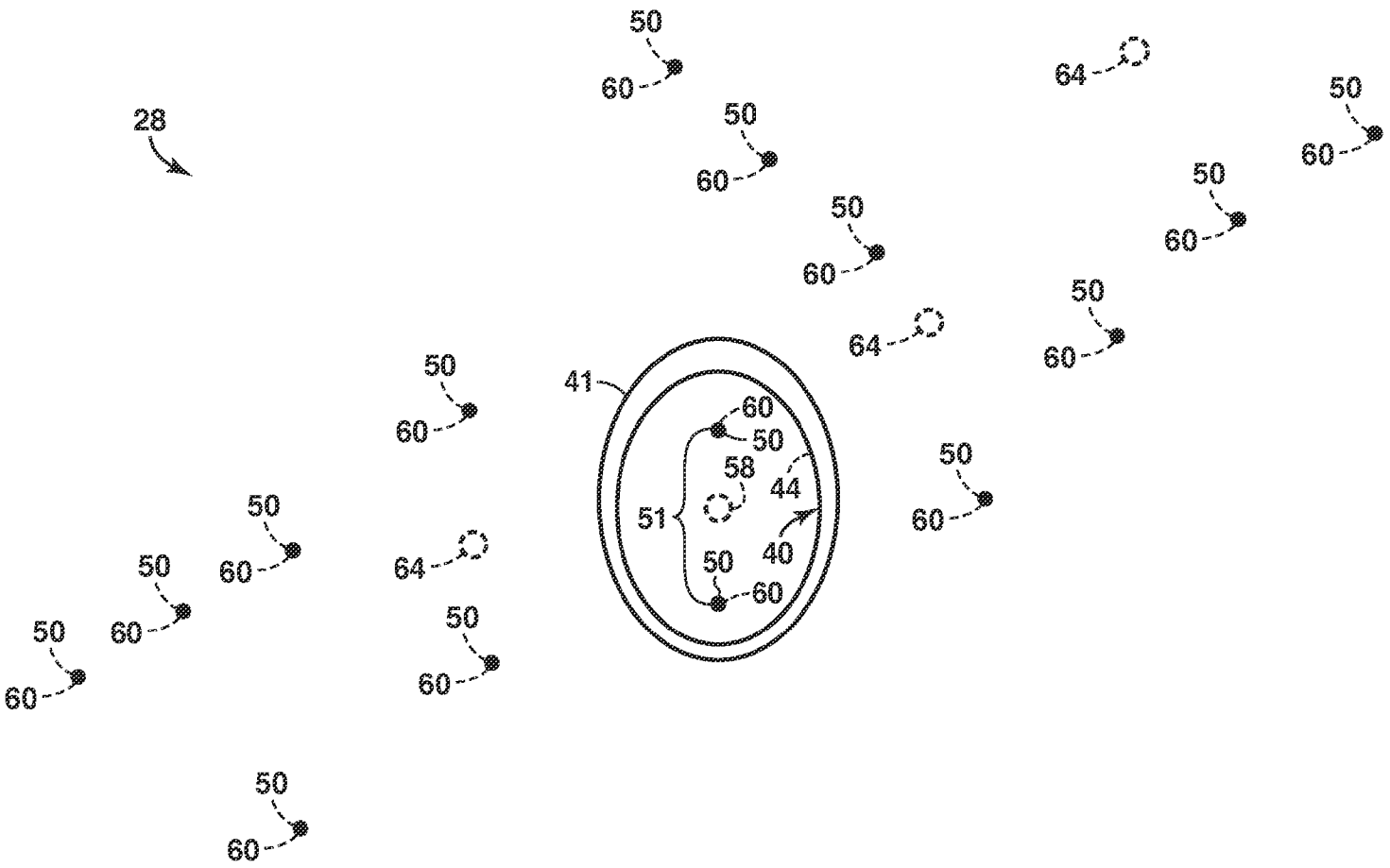
FIG. 1 is a schematic view of a subterranean formation with electrodes.

It should be noted that the figures are merely examples and no limitations on the scope of the present disclosure are intended thereby. Further, the figures are generally not drawn to scale, but are drafted for purposes of convenience and clarity in illustrating various aspects of the disclosure.

DETAILED DESCRIPTION

For the purpose of promoting an understanding of the principles of the disclosure, reference will now be made to the features illustrated in the drawings and specific language will be used to describe the same. It will nevertheless be understood that no limitation of the scope of the disclosure is thereby intended. Any alterations and further modifications, and any further applications of the principles of the disclosure as described herein are contemplated as would normally occur to one skilled in the art to which the disclosure relates. It will be apparent to those skilled in the relevant art that some features that are not relevant to the present disclosure may not be shown in the drawings for the sake of clarity.

Thermal generation and stimulation techniques may be used to produce subterranean hydrocarbons within, for example, subterranean regions within a subterranean formation that contain and/or include organic matter, and which may include large hydrocarbon molecules (e.g., heavy oil, bitumen, and/or kerogen). Hydrocarbons may be produced by heating for a sufficient period of time. In some instances, it may be desirable to perform in situ upgrading of the hydrocarbons, i.e., conversion of the organic matter to more mobile forms (e.g., gas or liquid) and/or to more useful forms (e.g., smaller, energy-dense molecules). In situ upgrading may include performing at least one of a shale oil retort process, a shale oil heat treating process, a hydrogenation reaction, a thermal dissolution process, and an in situ shale oil conversion process. An shale oil retort process, which also may be referred to as destructive distillation, involves heating oil shale in the absence of oxygen until kerogen within the oil shale decomposes into liquid and/or gaseous hydrocarbons. In situ upgrading via a hydrogenation reaction includes reacting organic matter with molecular hydrogen to reduce, or saturate, hydrocarbons within the organic matter. In situ upgrading via a thermal dissolution process includes using hydrogen donors and/or solvents to dissolve organic matter and to crack kerogen and more complex hydrocarbons in the organic matter into shorter hydrocarbons. Ultimately, the in situ upgrading may result in liquid and/or gaseous hydrocarbons that may be extracted from the subterranean formation.

When the in situ upgrading includes pyrolysis (thermochemical decomposition), in addition to producing liquid and/or gaseous hydrocarbons, a residue of carbonaceous coke may be produced in the subterranean formation. Pyrolysis of organic matter may produce at least one of liquid hydrocarbons, gaseous hydrocarbons, shale oil, bitumen, pyrobitumen, bituminous coal, and coke. For example, pyrolysis of kerogen may result in hydrocarbon gas, shale oil, and/or coke. Generally, pyrolysis occurs at elevated temperatures. For example, pyrolysis may occur at temperatures of at least 250° C., at least 350° C., at least 450° C., at least 550° C., at least 700° C., at least 800° C., at least 900° C., and/or within a range that includes or is bounded by any of the preceding examples of pyrolyzation temperatures. As additional examples, it may be desirable not to overheat the region to be pyrolyzed. Examples of pyrolyzation temperatures include temperatures that are less than 1000° C., less than 900° C., less than 800° C., less than 700° C., less than 550° C., less than 450° C., less than 350° C., less than 270° C., and/or within a range that includes or is bounded by any of the preceding examples of pyrolyzation temperatures.

Bulk rock in a subterranean formation 28 may contain organic matter. Bulk rock generally has a low electrical conductivity (equivalently, a high electrical resistivity), typically on the order of $10^{-7}$-$10^{-4}$ S/m (a resistivity of about $10^{4}$-$10^{7}$ Ωm). For example, the average electrical conductivity within a subterranean formation, or a region within the subterranean formation, may be less than $10^{-3}$ S/m, less than $10^{-4}$ S/m, less than $10^{-5}$ S/m, less than $10^{-6}$ S/m, and/or within a range that includes or is bounded by any of the preceding examples of average electrical conductivities. Most types of organic matter found in subterranean formations have similarly low conductivities. However, the residual coke resulting from pyrolysis is relatively enriched in carbon and has a relatively higher electrical conductivity. For example, Green River oil shale (a rock including kerogen) may have an average electrical conductivity in ambient conditions of about $10^{-7}$-$10^{-6}$ S/m. As the Green River oil shale is heated to between about 300° C. and about 600° C., the average electrical conductivity may rise to greater than $10^{-5}$ S/m, greater than 1 S/m, greater than 100 S/m, greater than 1,000 S/m, even greater than 10,000 S/m, or within a range that includes or is bounded by any of the preceding examples of electrical conductivities. This increased electrical conductivity may remain even after the rock returns to lower temperatures.

Continued heating (increasing temperature and/or longer duration) may not result in further increases of the electrical conductivity of a subterranean region. Other components of the subterranean formation, e.g., carbonate minerals such as dolomite and calcite, may decompose at a temperature similar to useful pyrolysis temperatures. For example, dolomite may decompose at about 550° C., while calcite may decompose at about 700° C. Decomposition of carbonate minerals generally results in carbon dioxide, which may reduce the electrical conductivity of subterranean regions neighboring the decomposition. For example, decomposition may result in an average electrical conductivity in the subterranean regions of less than 0.1 S/m, less than 0.01 S/m, less than $10^{-3}$ S/m, less than $10^{-4}$ S/m, less than $10^{-5}$ S/m, and/or within a range that includes or is bounded by any of the preceding examples of average electrical conductivities.

If a pyrolyzed subterranean region has sufficient electrical conductivity, generally greater than about $10^{-5}$ S/m, the region may be described as an electrically conductive zone. An electrically conductive zone may include bitumen, pyrobitumen, bituminous coal, and/or coke produced by pyrolysis. An electrically conductive zone is a region within a subterranean formation that has an electrical conductivity greater than, typically significantly greater than, the unaffected bulk rock of the subterranean formation. For example, the average electrical conductivity of an electrically conductive zone may be at least $10^{-5}$ S/m, at least $10^{-4}$ S/m, at least $10^{-3}$ S/m, at least 0.01 S/m, at least 0.1 S/m, at least 1 S/m, at least 10 S/m, at least 100 S/m, at least 300 S/m, at least 1,000 S/m, at least 3,000 S/m, at least 10,000 S/m, and/or within a range that includes or is bounded by any of the preceding examples of average electrical conductivities.

The residual coke after pyrolysis may form an electrically conductive zone that may be used to conduct electricity and act as an in situ resistive heating element for continued upgrading of the hydrocarbons. An in situ resistive heating element may include an electrically conductive zone that has a conductivity sufficient to cause ohmic losses, and thus resistive heating, when electrically powered by at least two electrodes. For example, the average electrical conductivity of an in situ resistive heating element 40 may be at least $10^{-5}$ S/m, at least $10^{-4}$ S/m, at least $10^{-3}$ S/m, at least 0.01 S/m, at least 0.1 S/m, at least 1 S/m, at least 10 S/m, at least 100 S/m, at least 300 S/m, at least 1,000 S/m, at least 3,000 S/m, and/or at least 10,000 S/m, and/or within a range that includes or is bounded by any of the preceding examples of average electrical conductivities. An in situ resistive heating element 40 that can expand, such as due to the heat produced by the resistive heating element, also may be referred to as a self-amplifying heating element.

When electrical power is applied to the in situ resistive heating element, resistive heating heats the heating element. Neighboring (i.e., adjacent, contiguous, and/or abutting) regions of the subterranean formation may be heated primarily by conduction of the heat from the in situ resistive heating element. The heating of the subterranean formation, including the organic matter, may cause pyrolysis and consequent increase in conductivity of the subterranean region. Under voltage-limited conditions (e.g., approximately constant voltage conditions), an increase in conductivity (decrease in resistivity) causes increased resistive heating. Hence, as electrical power is applied to the in situ resistive heating element, the heating of neighboring regions creates more electrically conductive zones. These zones may become a part of a growing, or expanding, electrically conductive zone and in situ resistive heating element, provided that sufficient current can continue to be supplied to the (expanding) in situ resistive heating element. Alternatively expressed, as the subterranean regions adjacent to the actively heated in situ resistive heating element become progressively more conductive, the electrical current path begins to spread to these newly conductive regions and thereby expands the extent of the in situ resistive heating element.

For subterranean regions that contain interfering components such as carbonate minerals, the pyrolysis and the expansion of the in situ resistive heating element may be accompanied by a local decrease in electrical conductivity (e.g., resulting from the decomposition of carbonate in the carbonate minerals and/or other interfering components). Generally, decomposition of any such interfering components occurs in the hottest part of the expanding in situ resistive heating element, e.g., the central volume, or core, of the heating element. These two effects, an expanding exterior of the in situ resistive heating element and an expanding low conductivity core, may combine to form a shell of rock that is actively heating. A shell-shaped in situ resistive heating element may be beneficial because the active heating would be concentrated in the shell, generally a zone near unpyrolyzed regions of the subterranean formation. The central volume, which was already pyrolyzed, may have little to no further active heating. Aside from concentrating the heating on a more useful (such as a partially or to-be-pyrolyzed) subterranean region, the shell configuration also may reduce the total electrical power requirements to power the shell-shaped in situ resistive heating element as compared to a full-volume in situ resistive heating element.

FIGS. 1-5 are schematic views of a subterranean formation 28 including organic matter. These figures show various electrodes 50 within the subterranean formation 28 along with in situ resistive heating elements 40 at various points in time, such as before, during, and/or after performance of methods 10. FIG. 6 is a flowchart illustrating methods 10 for pyrolyzing organic matter in a subterranean formation 28, namely, by in situ resistive heating of the organic matter within the subterranean formation. FIGS. 7-10 are schematic views of various electrode arrangements. The various electrode arrangements illustrate some of the options for configuring and/or placing electrodes 50 within a subterranean formation 28. FIG. 11 is a schematic cross-sectional view of a system for pyrolyzing organic matter within a subterranean formation 28.

FIGS. 1-5 and 7-11 provide examples of systems and configurations that contain an in situ resistive heating element 40, which may be a self-amplifying in situ heating element, and/or which are formed via methods 10. Elements that serve a similar, or at least substantially similar, purpose are labeled with like numbers in each of FIGS. 1-5 and 7-11. Each of these elements may not be discussed in detail with reference to each of FIGS. 1-5 and 7-11. Similarly, all elements may not be labeled in each of FIGS. 1-5 and 7-11, but reference numerals associated therewith may be used for consistency. Elements that are discussed with reference to one or more of FIGS. 1-5 and 7-11 may be included in and/or used with any of FIGS. 1-5 and 7-11 without departing from the scope of the present disclosure. In general, elements that are likely to be included are illustrated in solid lines, while elements that are optional are illustrated in dashed lines. However, elements that are shown in solid lines may not be essential. Thus, an element shown in solid lines may be omitted without departing from the scope of the present disclosure.

Generally, FIGS. 1-5 and 7-11 schematically illustrate the control and growth of in situ resistive heating elements 40 to pyrolyze organic matter within a subterranean formation 28, such as via methods 10. As viewed in FIG. 1, a subterranean formation 28 may include a first region 41 which may enclose a first generation in situ resistive heating element 44. A first generation in situ resistive heating element 44 is an electrically conductive zone within the first region 41. First region 41 is in electrical contact with at least two electrodes 50, which may be referred to as a first electrode pair 51. The subterranean formation 28 also may include one or more electrodes 50 that are not in electrical contact with the first generation in situ resistive heating element 44, at least not at the time point illustrated in FIG. 1.

Figure 2:
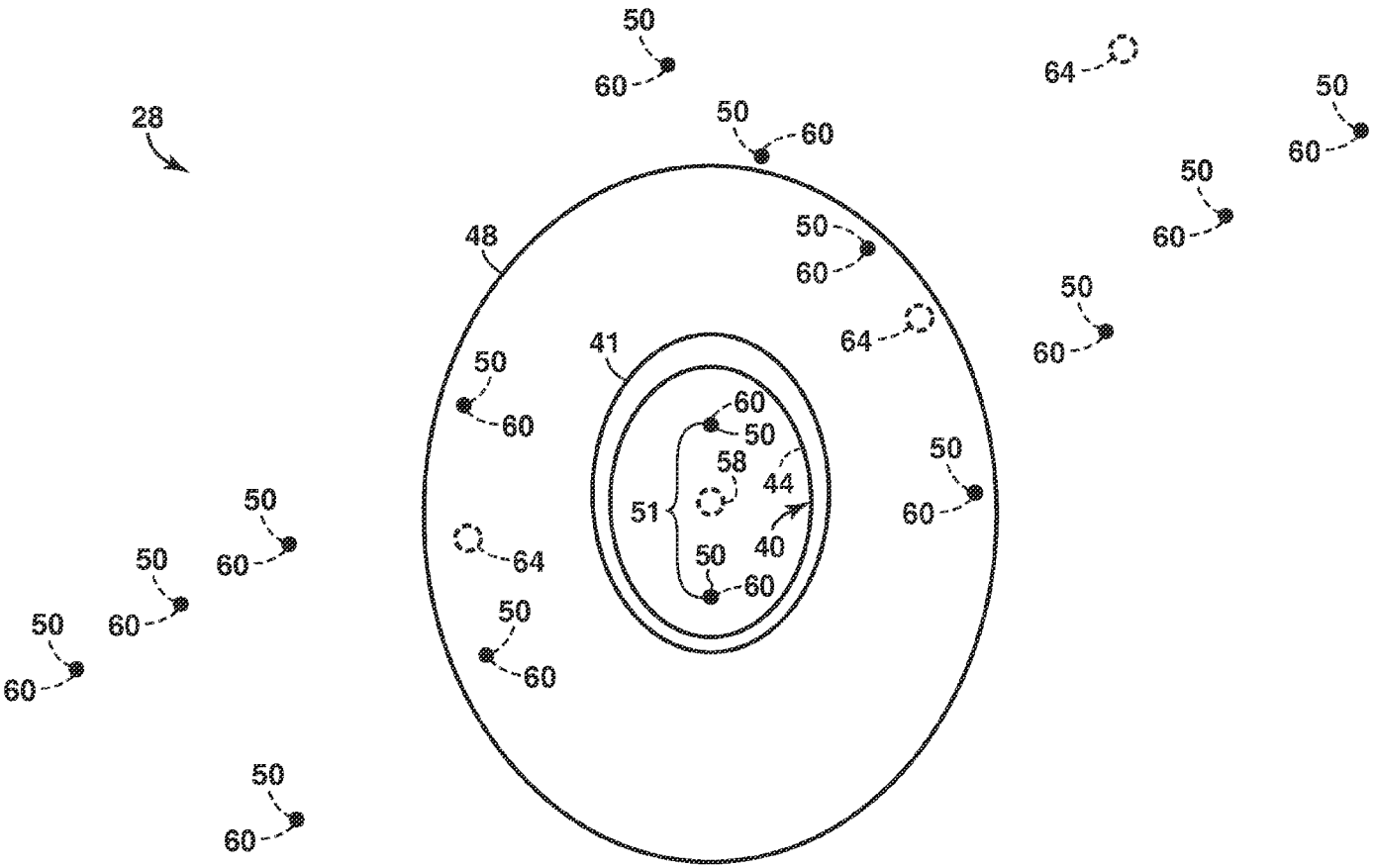
FIG. 2 is a schematic view of the subterranean formation of FIG. 1 after powering a first generation in situ resistive heating element.

FIG. 2 illustrates the subterranean formation 28 and electrode 50 arrangement of FIG. 1 after electrically powering the first generation in situ resistive heating element 44 to heat a portion of the subterranean formation 28 that includes the first generation in situ resistive heating element 44. The first generation in situ resistive heating element 44 may be powered via the first electrode pair 51. The heating may cause pyrolysis of organic matter contained within the heated portion and consequently may increase the average electrical conductivity of the heated portion. In FIG. 2, the powering has resulted in an expansion of the electrically conductive zone, which may be referred to as an aggregate electrically conductive zone 48. Initially (in FIG. 1), the electrically conductive zone was coextensive with the first generation in situ resistive heating element 44. After powering (as viewed in FIG. 2), the aggregate electrically conductive zone 48 may be larger, i.e., expanded.

The aggregate electrically conductive zone 48 may expand sufficiently to electrically contact one or more electrodes 50 that were not initially contacted by the in situ resistive heating element 40, i.e., prior to the expansion of the aggregate electrically conductive zone 48. Hence, the expansion of the aggregate electrically conductive zone 48 results in the electrical contact of a pair of electrodes 50 that is distinct from the first electrode pair 51.

Figure 3:
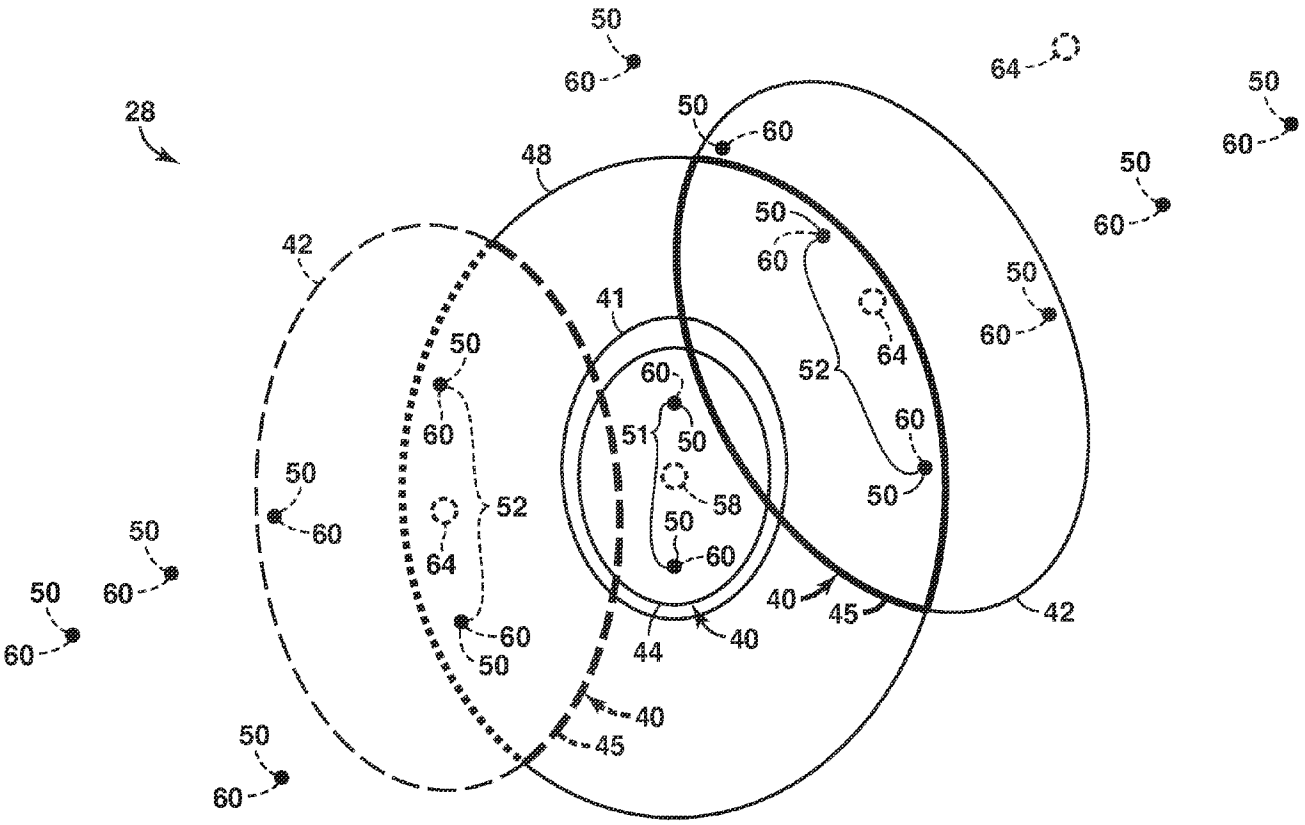
FIG. 3 is a schematic view of the subterranean formation of FIG. 2 identifying at least one second region.

FIG. 3 illustrates one or more second regions 42 that intersect the (expanded) aggregate electrically conductive zone 48. Second regions 42 are generally subterranean regions, adjacent to the first region 41. Each second region 42 encloses a portion of the aggregate electrically conductive zone 48 but is distinct/separate from first region 41 and, when present, other second region(s) 42. Second region 42 may intersect and/or adjoin the first region 41. Second region 42 may be spaced apart from the first region 41 and/or at least one other second region 42. Each second region 42 may include a second generation in situ resistive heating element 45, a portion of the aggregate electrically conductive zone 48 within the second region 42 that is electrically contacted by a second electrode pair 52. Each second electrode pair 52 may be distinct from the first electrode pair 51, as well as other second electrode pairs 52.

Figure 4:
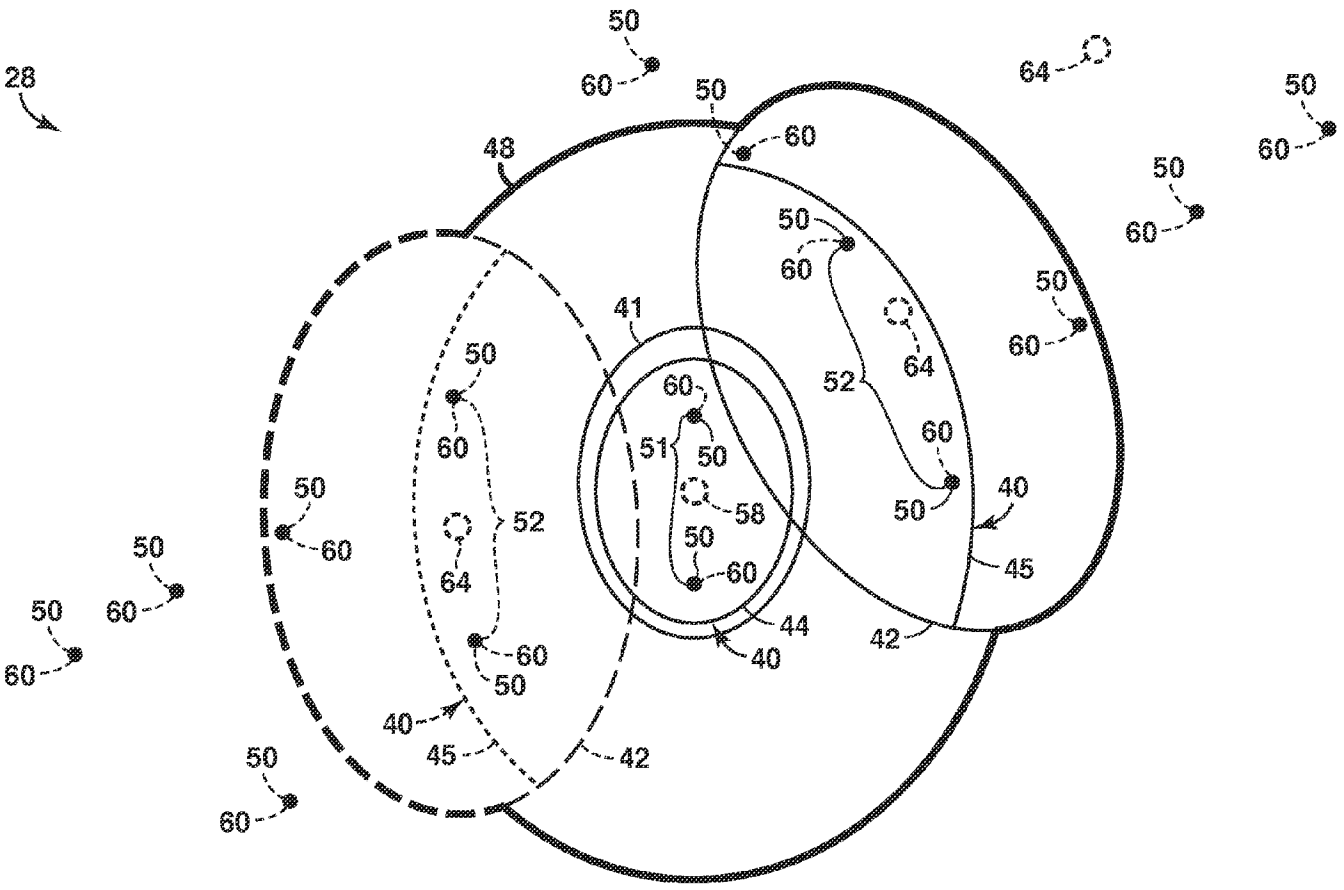
FIG. 4 is a schematic view of the subterranean formation of FIG. 3 after powering a second generation in situ resistive heating element.

Once electrical contact between the second electrode pair 52 and the aggregate electrically conductive zone 48 is established, forming a second generation in situ resistive heating element 45, the second generation in situ resistive heating element 45 may be used to heat the second region 42 and neighboring regions of the subterranean formation 28. Electrically powering the second generation in situ resistive heating element 45 may heat a portion of the subterranean formation 28 that includes the second generation in situ resistive heating element 45. The second generation in situ resistive heating element 45 may be powered via the second electrode pair 52. The heating may cause pyrolysis of organic matter contained within the heated portion. The heating may increase the average electrical conductivity of the heated portion. In FIG. 4, the powering has resulted in further expansion of the electrically conductive zone, resulting in an aggregate electrically conductive zone 48 that is larger than the aggregate electrically conductive zone 48 of FIG. 3.

FIG. 4 illustrates the (further expanded) aggregate electrically conductive zone 48 after it has expanded sufficiently to electrically contact one or more electrodes 50 that were not contacted by the aggregate electrically conductive zone 48 prior to the expansion. Hence, the expansion of the aggregate electrically conductive zone 48 results in the electrical contact of a pair of electrodes 50 that is distinct from the second electrode pair 52.

FIG. 4 also illustrates continued expansion of the aggregate electrically conductive zone 48 as a result of continued powering of the first generation in situ resistive heating element 44. Any pair of electrodes 50 within the aggregate electrically conductive zone 48, whether in contact with the first region 41 or a second region 42, may be operated independently to electrically power one or more of the first generation in situ resistive heating element 44 and the second generation in situ resistive heating element(s) 45.

Figure 5:
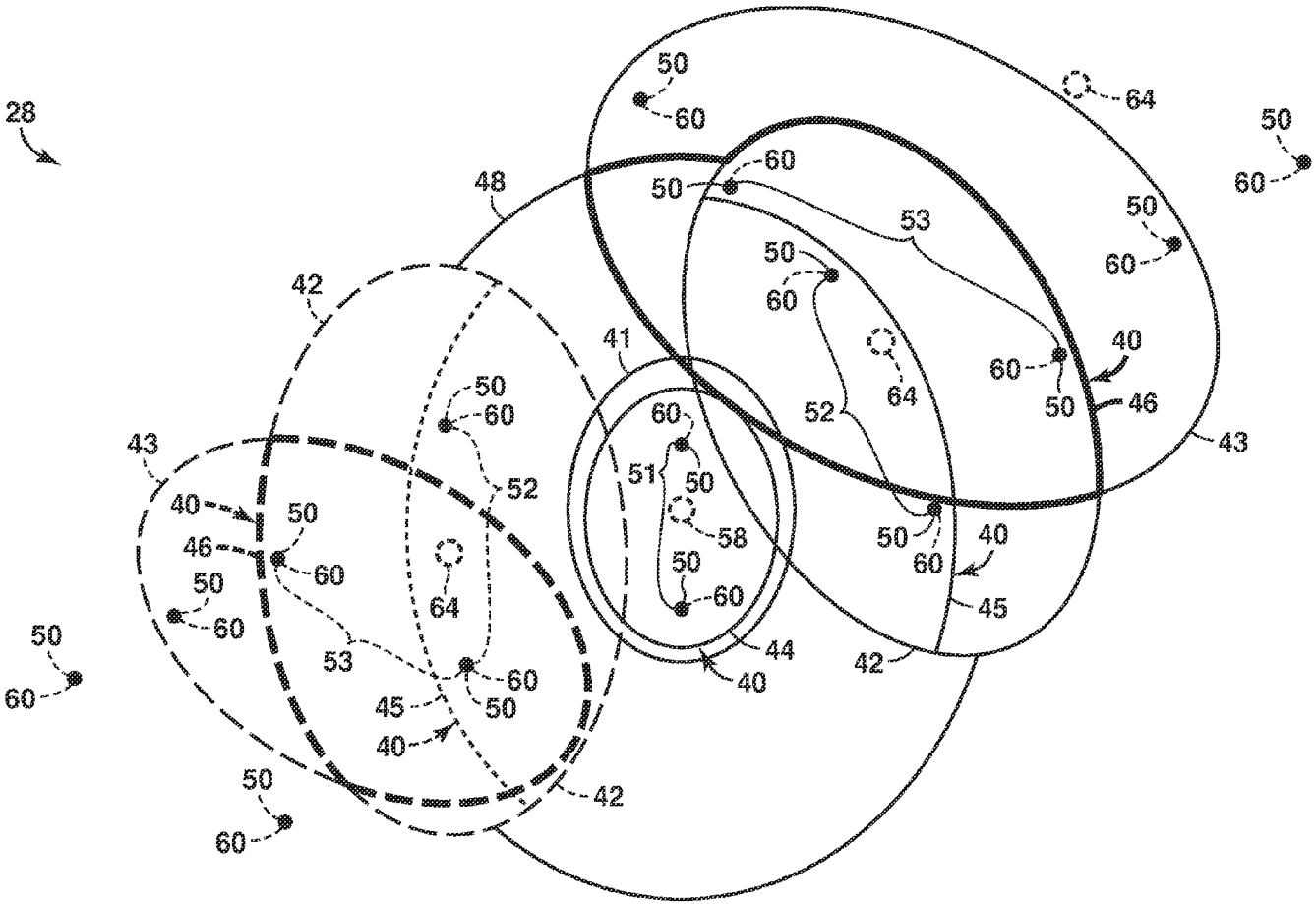
FIG. 5 is a schematic view of the subterranean formation of FIG. 4 identifying at least one third region.
Figure 6:
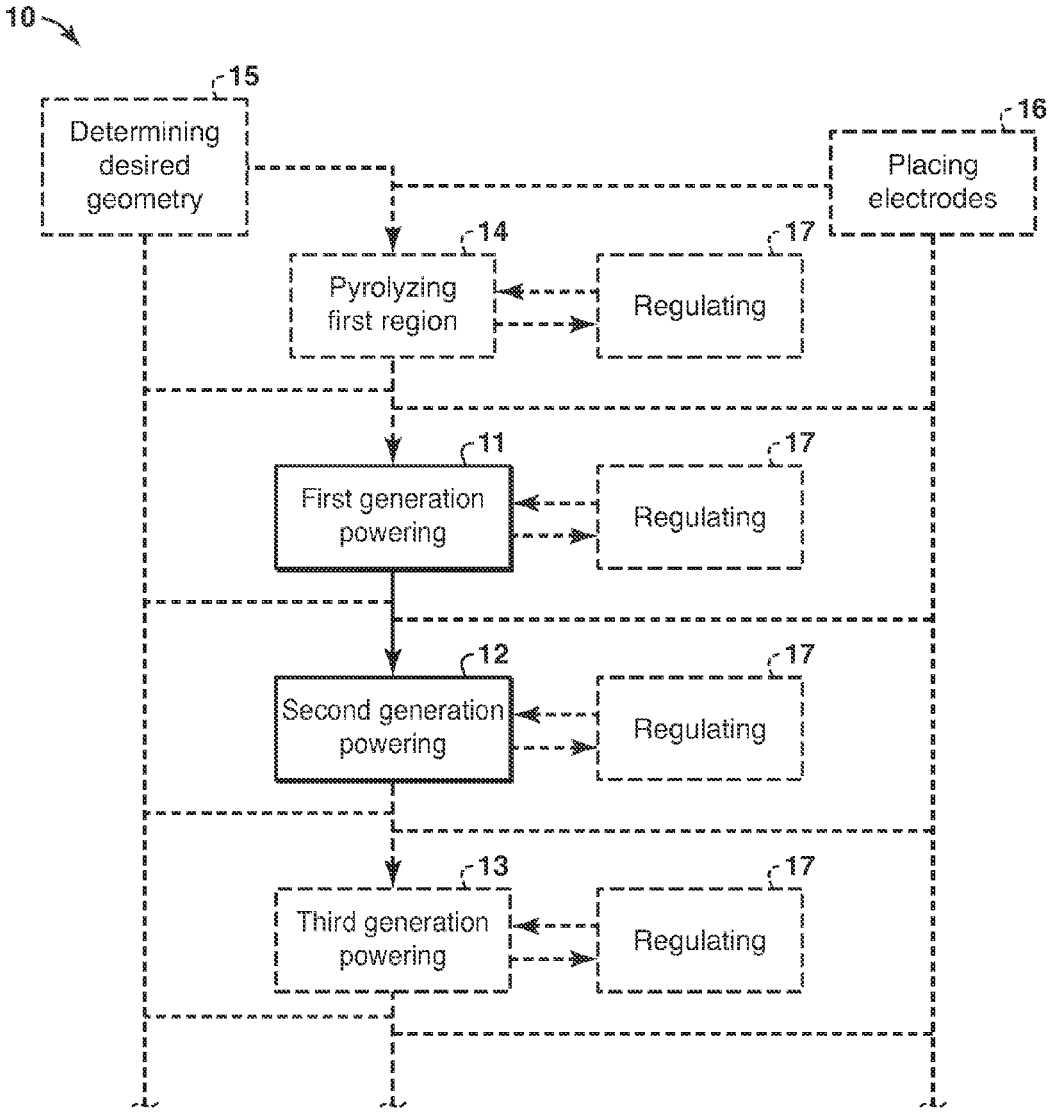
FIG. 6 is a flowchart depicting methods for in situ resistive heating of organic matter in a subterranean formation.

FIG. 5 illustrates one or more third regions 43 that intersect the (further expanded) aggregate electrically conductive zone 48. Third regions 43 are generally subterranean regions, adjacent to a second region 42. Each third region 43 encloses a portion of the aggregate electrically conductive zone 48 but is distinct/separate from first region 41, second region(s) 42, and (when present) other third region(s) 43. Third region 43 may intersect and/or adjoin at least one of the first region 41 and the second region(s) 42. Third region 43 may be spaced apart from at least one of the first region 41, the second region(s) 42, and/or at least one other third region 43. Each third region 43 may include a third generation in situ resistive heating element 46, a portion of the aggregate electrically conductive zone 48 within the third region 43 that is electrically contacted by a third electrode pair 53. Each third electrode pair 53 may be distinct from the first electrode pair 51, second pairs of electrodes 52, and other third electrode pairs 53.

Once electrical contact between the third electrode pair 53 and the aggregate electrically conductive zone 48 is established, forming a third generation in situ resistive heating element 46, the third generation in situ resistive heating element 46 may be used to heat the third zone 43. Electrically powering the third generation in situ resistive heating element 46 may heat a portion of the subterranean formation 28 including the third generation in situ resistive heating element 46. The third generation in situ resistive heating element 46 may be powered via the third electrode pair 53. The heating may cause pyrolysis of organic matter contained within the heated portion and consequently may increase the average electrical conductivity of the portion. The powering may result in further expansion of the aggregate electrically conductive zone 48, potentially contacting further electrodes 50.

A subterranean formation 28 may be any suitable structure that includes and/or contains organic matter (FIGS. 1-5). For example, the subterranean formation 28 may contain at least one of oil shale, shale gas, coal, tar sands, organic-rich rock, kerogen, and bitumen. The subterranean formation 28 may be a geological formation, a geological member, a geological bed, a rock stratum, a lithostratigraphic unit, a chemostratigraphic unit, and/or a biostratigraphic unit, or groups thereof. The subterranean formation 28 may have a thickness less than 2000 m, less than 1500 m, less than 1000 m, less than 500 m, less than 250 m, less than 100 m, less than 80 m, less than 60 m, less than 40 m, less than 30 m, less than 20 m, and/or less than 10 m. The subterranean formation 28 may have a thickness that is greater than 5 m, greater than 10 m, greater than 20 m, greater than 30 m, greater than 40 m, greater than 60 m, greater than 80 m, greater than 100 m, greater than 250 m, greater than 500 m, greater than 1000 m, and/or greater than 1500 m. Additionally, the subterranean formation may have a thickness of any of the preceding examples of maximum and minimum thicknesses and/or a thickness in a range that is bounded by any of the preceding examples of maximum and minimum values.

Electrodes 50 may be electrically conductive elements, typically including metal and/or carbon, that may be in electrical contact with a portion of the subterranean formation 28. Electrical contact includes contact sufficient to transmit electrical power, including AC and DC power. Electrical contact may be established between two elements by direct contact between the elements. Two elements may be in electrical contact when indirectly linked by intervening elements, provided that the intervening elements are at least as conductive as the least conductive of the two connected elements, i.e., the intervening elements do not dominate current flow between the elements in contact. The conductance of an element is proportional to its conductivity and its cross sectional area, and inversely proportional to its current path length. Hence, small elements with low conductivities may have high conductance.

Whether a subterranean region is poorly electrically conductive (e.g., having an electrical conductivity below $10^{-4}$ S/m) or not poorly electrically conductive (e.g., having an electrical conductivity above $10^{-4}$ S/m and alternatively referred to as highly electrically conductive), an electrode 50 may be in electrical contact with the subterranean region by direct contact between the electrode 50 and the region and/or by indirect contact via suitable conductive intervening elements. For example, remnants from drilling fluid (mud), though typically not highly electrically conductive (typical conductivities range from $10^{-5}$ S/m to 1 S/m), may be sufficiently electrically conductive to provide suitable electrical contact between an electrode 50 and a subterranean region. Where an electrode 50 is situated within a wellbore, the electrode may be engaged directly against the wellbore, or an electrically conductive portion of the casing of the wellbore, thus causing electrical contact between the electrode and the subterranean region surrounding the wellbore. An electrode 50 may be in electrical contact with a subterranean region through subterranean spaces (e.g., natural and/or manmade fractures; voids created by hydrocarbon production) filled with electrically conductive materials (e.g., graphite, coke, and/or metal particles).

Electrodes 50 may be operated in spaced-apart pairs (two or more electrodes), for example, a first electrode pair 51, a second electrode pair 52, a third electrode pair 53, etc. A pair of electrodes 50 may be used to electrically power an in situ resistive heating element in electrical contact with each of the electrodes 50 of the pair. Electrical power may be transmitted between more than two electrodes 50. Two electrodes 50 may be held at the same electrical potential while a third electrode 50 is held at a different potential. Two or more electrodes may transmit AC power with each electrode transmitting a different phase of the power signal. Each of the first electrode pair 51, the second electrode pair 52, and the third electrode pair 53 may be distinct, meaning each pair includes an electrode not shared with another pair. Electrode pairs (the first electrode pair 51, the second electrode pair 52, and the third electrode pair 53) may include at least one shared electrode 50, provided that less than all electrodes 50 are shared with one other electrode pair.

Electrodes 50 may be contained at least partially within an electrode well 60 in the subterranean formation 28. Electrodes 50 may be placed at least partially within an electrode well 60. Electrode wells 60 may include one or more electrodes 50. In the case of multiple electrodes 50 contained within one electrode well 60, the electrodes 50 may be spaced apart and insulated from each other. One electrode well 60 may be placed for each electrode 50, for each electrode of the first electrode pair 51, for each electrode of the second electrode pair 52, and/or for each electrode of the third electrode pair 53. An electrode 50 may extend outside of an electrode well 60 and into the subterranean formation 28, for example, through a natural and/or manmade fracture.

An electrode well 60 may include an end portion that contains at least one electrode 50. End portions of electrode wells 60 may have a specific orientation relative to the subterranean formation 28, regions of the subterranean formation 28, and/or other electrode wells 60. For example, the end portion of one of the electrode wells 60 may be co-linear with, and spaced apart from, the end portion of another of the electrode wells 60. The end portion of one of the electrode wells 60 may be at least one of substantially parallel, parallel, substantially co-planar, and co-planar to the end portion of another of the electrode wells 60. The end portion of one of the electrode wells 60 may converge towards or diverge away from the end portion of another of the electrode wells 60. Where at least one of the subterranean formation 28, a region of the subterranean formation 28, and an in situ resistive heating element 40 is elongate with an elongate direction, the end portion of one of the electrode wells 60 may be at least one of substantially parallel, parallel, oblique, substantially perpendicular, and perpendicular to the elongate direction.

Electrode wells 60 may include a portion, optionally including the end portion, that may be at least one of horizontal, substantially horizontal, inclined, vertical, and substantially vertical. Electrode wells 60 also may include a differently oriented portion, which may be at least one of horizontal, substantially horizontal, inclined, vertical, and substantially vertical.

A subterranean formation 28 may include a production well 64, from which hydrocarbons and/or other fluids are extracted or otherwise removed from the subterranean formation 28. A production well 64 may extract mobile hydrocarbons produced in the subterranean formation 28 by in situ pyrolysis. A production well 64 may be placed in fluidic contact with at least one of the subterranean formation 28, the first region 41, the first generation in situ resistive heating element 44, the second region(s) 42, the second generation in situ resistive heating element(s) 45, the third region(s) 43, and the third generation in situ resistive heating element(s) 46. A production well 64 may be placed prior to the generation of at least one of the in situ resistive heating elements 40. When present, an electrode well 60 may also serve as a production well 64, in which case the electrode well 60 may extract mobile components from the subterranean formation 28.

FIG. 6 illustrates methods 10, which describe the process of iteratively expanding an aggregate electrically conductive zone 48 into electrical contact with one or more electrodes 50 that were not previously contacted by the aggregate electrically conductive zone 48 (i.e., prior to the expansion of the aggregate electrically conductive zone 48). Methods 10 may comprise a first generation powering 11 of a first generation in situ resistive heating element 44 to expand an aggregate electrically conductive zone 48. Methods may include a second generation powering 12 to heat a second generation in situ resistive heating element 45 resulting from the expanding aggregate electrically conductive zone 48.

First generation powering 11 may include transmitting an electrical current between a first electrode pair 51 in electrical contact with the first generation in situ resistive heating element 44. First generation powering 11 may cause resistive heating within the first generation in situ resistive heating element 44 and consequently pyrolysis within the first region 41 and neighboring regions within the subterranean formation 28. For example, one or more second regions 42, each adjacent the first region 41, may be heated and pyrolyzed by the first generation powering 11.

Pyrolyzing a second region 42 by the first generation powering 11 may include increasing an average electrical conductivity of the second region 42 sufficiently to expand the aggregate electrically conductive zone 48 into the second region 42. The expansion of the aggregate electrically conductive zone 48 may cause electrical contact with an electrode 50 that extends within the second region 42 and/or that is outside the first region 41. The electrode 50 may extend within the second region 42 and/or be outside the first region 41 before, during, or after the expansion of the aggregate electrically conductive zone 48.

Once the first generation powering 11 establishes electrical contact between the aggregate electrically conductive zone 48 and at least one electrode 50 that was not in prior contact, the second generation powering 12 may begin. Second generation powering 12, analogous to first generation powering 11, may include electrically powering a second generation in situ resistive heating element 45 using a second electrode pair 52, by transmitting an electrical current between the electrodes 50. Second generation powering 12 may cause resistive heating within the second generation in situ resistive heating element 45 and consequently pyrolysis within the second region 42 and neighboring regions within the subterranean formation 28. For example, one or more third regions 43, adjacent at least one second region 42, may be heated and pyrolyzed by the second generation powering 12.

Pyrolyzing a third region 43 by the second generation powering 12 may include increasing an average electrical conductivity of the third region 43 sufficiently to expand the aggregate electrically conductive zone 48 into the third region 43. The expansion of the aggregate electrically conductive zone 48 may cause electrical contact with an electrode 50 that extends within the third region 43 and/or that is outside the first region 41 and the second region(s) 42. The electrode 50 may extend within the third region 43 and/or be outside the first region 41 and the second region(s) 42 before, during, or after the expansion of the aggregate electrically conductive zone 48.

Once the second generation powering 12 establishes electrical contact between the aggregate electrically conductive zone 48 and at least one electrode 50 that was not in prior contact, a third generation powering 13 may begin. Third generation powering 13, analogous to first generation powering 11 and second generation powering 12, may include electrically powering a third generation in situ resistive heating element 46 using a third electrode pair 53, by transmitting an electrical current between the electrodes 50. Third generation powering 13 may cause resistive heating within the third generation in situ resistive heating element 46. Third generation powering 13 may cause pyrolysis within the third region 43. Third generating powering 13 may cause pyrolysis within neighboring regions within the subterranean formation 28. For example, one or more fourth regions, adjacent at least one third region 43, may be heated and pyrolyzed by the third generation powering 13.

The iterative cycle of powering an in situ resistive heating element 40, thereby expanding the aggregate electrically conductive zone 48, and powering another in situ resistive heating element 40 within the expanded aggregate electrically conductive zone 48 may continue to a fourth generation, a fifth generation, etc., as indicated by the continuation lines at the bottom of FIG. 6.

Once electrical contact is established with an in situ resistive heating element 40, powering of that in situ resistive heating element 40 may begin regardless of whether the powering that generated the electrical contact continues. Electrical powering of each in situ resistive heating element 40 may be independent and/or may be independently controlled.

First generation powering 11, second generation powering 12, third generation powering 13, etc. may occur at least partially concurrently and/or at least partially sequentially. As examples, second generation powering 12 may sequentially follow the completion of first generation powering 11. Third generation powering may sequentially follow the completion of second generation powering 12. First generation powering 11 may cease before, during, or after either of second generation powering 12 and third generation powering 13. Second generation powering 12 may include at least partially sequentially and/or at least partially concurrently powering each of the second generation in situ resistive heating element(s) 45. Third generation powering 13 may include at least partially sequentially and/or at least partially concurrently powering each of the third generation in situ resistive heating element(s) 46.

Concurrently powering may include at least partially concurrently performing the first generation powering 11, the second generation powering 12, and/or the third generation powering 13; or at least partially concurrently powering two or more second generation in situ resistive heating element(s) 45 and/or third generation in situ resistive heating element(s) 46. Concurrently powering may include partitioning electrical power between the active (powered) in situ resistive heating elements 40. As examples, beginning the second generation powering 12 may include reducing power to the first generation in situ resistive heating element 44 and/or ceasing the first generation powering 11. Second generation powering 12 may include powering two second generation in situ resistive heating element(s) 46 with unequal electrical powers. Third generation powering 13 may include reducing power to one or more second generation in situ resistive heating element(s) 45 and/or the first generation in situ resistive heating element 44.

Further, although not required, independent control of in situ resistive heating elements 40 effectively may be utilized to split and/or partition the aggregate electrically conductive zone 48 into several independent active in situ resistive heating elements 40. These independently-controlled in situ resistive heating elements 40 may remain in electrical contact with each other, or, because of changing conductivity due to heating (and/or overheating), may not be in electrical contact with at least one other in situ resistive heating element 40.

First generation powering 11, second generation powering 12, and/or third generation powering 13 may include transmitting electrical current for a suitable time to pyrolyze organic matter within the corresponding region of the subterranean formation 28 and to expand the in situ resistive heating element 40 into a produced electrically conductive zone in an adjacent region of the subterranean formation. For example, first generation powering 11, second generation powering 12, and/or third generation powering 13 each independently may include transmitting electrical current for at least one day, at least one week, at least two weeks, at least three weeks, at least one month, at least two months, at least three months, at least four months, at least five months, at least six months, at least one year, at least two years, at least three years, at least four years, or within a range that includes or is bounded by any of the preceding examples of time.

Methods 10 may comprise pyrolyzing 14 at least a portion of the first region 41, for example, to generate an aggregate electrically conductive zone 48 and/or a first generation in situ resistive heating element 44 within the first region 41. The pyrolyzing 14 may include heating the first region 41. Heating may be accomplished, for example, using a conventional heating element 58 or initiating combustion within the subterranean formation 28. For example, a conventional heating element 58 may be or include a wellbore heater and/or a granular resistive heater (a heater formed with resistive materials placed within a wellbore or the subterranean formation 28). Pyrolyzing 14 the first region 41 may include transmitting electrical current between electrodes 50 (e.g., a first electrode pair 51) in electrical contact with the first region 41 (e.g., by electrolinking). Pyrolyzing 14 the first region 41 may include transmitting electrical current between electrodes 50 (e.g., a first electrode pair 51) in electrical contact with the first generation in situ resistive heating element 44, once the first generation in situ resistive heating element 44 begins to form. Pyrolyzing 14 the first region 41 may include generating heat with the first generation in situ resistive heating element 44 to heat the first region 41. Pyrolyzing the first region 41 may include increasing an average electrical conductivity of the first region 41.

Methods 10 may comprise determining 15 a desired geometry of an in situ resistive heating element 40 and/or the aggregate electrically conductive zone 48. The determining 15 may occur prior to first generation powering 11, the second generation powering 12, and/or the third generation powering 13. The determining 15 may be at least partially based on data relating to at least one of the subterranean formation 28 and the organic matter in the subterranean formation 28. For example, the determining 15 may be based upon geophysical data relating to a shape, an extent, a volume, a composition, a density, a porosity, a permeability, and/or an electrical conductivity of the subterranean formation 28 and/or a region of the subterranean formation 28. Determining 15 may include estimating, modeling, forecasting and/or measuring the heating, pyrolyzing, electrical conductivity, permeability, and/or hydrocarbon production of the subterranean formation 28 and/or a region of the subterranean formation 28.

Methods 10 may comprise placing 16 electrodes 50 into electrical contact with at least a portion of the subterranean formation 28. As examples, placing 16 may include placing the first electrode pair 51 into electrical contact with the first generation in situ resistive heating element 44 and/or the first region 41. Placing 16 may include placing at least one of the second electrode pair 52 into electrical contact with the second region 42. Further, placing 16 may include placing at least one of the second electrode pair 52 within the subterranean formation 28 outside of the first generation in situ resistive heating element 44. Electrodes 50 may be placed in anticipation of growth of the aggregate electrically conductive zone 48. Electrodes 50 may be placed to guide and/or direct the aggregate electrically conductive zone 48 toward subterranean regions of potentially higher productivity and/or of higher organic matter content.

Placing 16 may occur at any time. Placing 16 an electrode 50 may be more convenient and/or practical before heating the portion of the subterranean formation 28 that will neighbor (i.e., be adjacent to), much less include, the placed electrode 50. The first electrode pair 51 may be placed 16 into electrical contact with the first region 41 prior to the creation of the first generation in situ resistive heating element 44. The second electrode pair 52 may be placed into electrical contact with the second region 42 prior to the creation of the first generation in situ resistive heating element 44 and/or the second generation in situ resistive heating element 45. The second electrode pair 52 may be placed within the subterranean formation 28 outside of the first region 41 prior to the creation of the first generation in situ resistive heating element 44 and/or the second generation in situ resistive heating element 45. Placing 16 may occur after determining 15 a desired geometry for an in situ resistive heating element 40 and/or the aggregate electrically conductive zone 48.

Placing 16 electrodes 50 into electrical contact with at least a portion of the subterranean formation 28 may include placing an electrode well 60 that contains at least one electrode 50. Placing 16 also may include placing an electrode 50 into an electrode well 60. Placing electrode wells 60 may occur at any time prior to electrical contact of the electrodes 50 with the subterranean formation 28. In particular, similar to the placing 16 of electrodes 50, placing an electrode well 60 may be more convenient and/or practical before heating the portion of the subterranean formation 28 that will neighbor and/or include the placed electrode well 60. For example, drilling a well may be difficult at temperatures above the boiling point of drilling fluid components. An electrode well 60 may be placed into the subterranean formation 28 prior to the creation of the first generation in situ resistive heating element 44 and/or the second generation in situ resistive heating element 45. An electrode well 60 may be placed within the subterranean formation 28 outside of the first region 41 prior to the creation of the first generation in situ resistive heating element 44 and/or the second generation in situ resistive heating element 45. An electrode well 60 may be placed within the subterranean formation 28 after the determining 15 a desired geometry.

Methods 10 may comprise regulating 17 the creation of an in situ resistive heating element 40 and/or pyrolyzation of a subterranean region. Regulating 17 may include monitoring a parameter before, during, and/or after powering (e.g., first generation powering 11, second generation powering 12, third generation powering 13, etc.). Regulating 17 may include monitoring a parameter before, during, and/or after pyrolyzing. The monitored parameter may relate to at least one of the subterranean formation 28 and the organic matter in the subterranean formation 28. As examples, the monitored parameter may include geophysical data relating to a shape, an extent, a volume, a composition, a density, a porosity, a permeability, an electrical conductivity, an electrical property, a temperature, and/or a pressure of the subterranean formation 28 and/or a region of the subterranean formation 28. The monitored parameter may relate to the production of mobile components within the subterranean formation 28 (e.g., hydrocarbon production). The monitored parameter may relate to the electrical power applied to at least a portion of the subterranean formation 28. For example, the monitored parameter may include at least one of the duration of applied electrical power, the magnitude of electrical power applied, and the magnitude of electrical current transmitted. The magnitude may include the average value, the peak value, and/or the integrated total value.

Regulating 17 may include adjusting subsequent powering and/or pyrolyzing based upon a monitored parameter and/or based upon a priori data relating to the subterranean formation 28. A priori data may relate to estimates, models, and/or forecasts of the heating, pyrolyzing, electrical conductivity, permeability, and/or hydrocarbon production of the subterranean formation 28 and/or a region of the subterranean formation 28. Regulating 17 may include adjusting subsequent powering and/or pyrolyzing when a monitored parameter and/or a priori data are greater than, equal to, or less than a predetermined threshold. The adjusting may include starting, stopping, and/or continuing the powering of at least one in situ resistive heating element 40. The adjusting may include powering with an adjusted electrical power, electrical current, electrical polarity, and/or electrical power phase.

Regulating 17 may include partitioning electrical power among a plurality of in situ resistive heating elements 40. For example, first generation powering 11, second generation powering 12, and/or third generation powering 13 may be regulated to control the growth of the aggregate electrically conductive zone 48. Partitioning the electrical power may include controlling at least one of the duration of applied electrical power, the magnitude of electrical power applied, and the magnitude of electrical current transmitted. The magnitude may include the average value, the peak value, and/or the integrated total value.

FIGS. 7-10 illustrate arrangements of electrodes 50 within a subterranean formation 28 that may be suitable for systems 30 and/or for carrying out methods 10. Any of the electrodes 50 illustrated in FIGS. 7-10 may be substituted for any one or more electrodes 50 illustrated in FIGS. 1-5 and 11. Moreover, though the FIGS. 7-10 illustrate a first region 41 and a second region 42 (and corresponding components), the electrode arrangements of FIGS. 7-10 are equally applicable to any subterranean region and/or any in situ resistive heating element 40.

Figure 7:
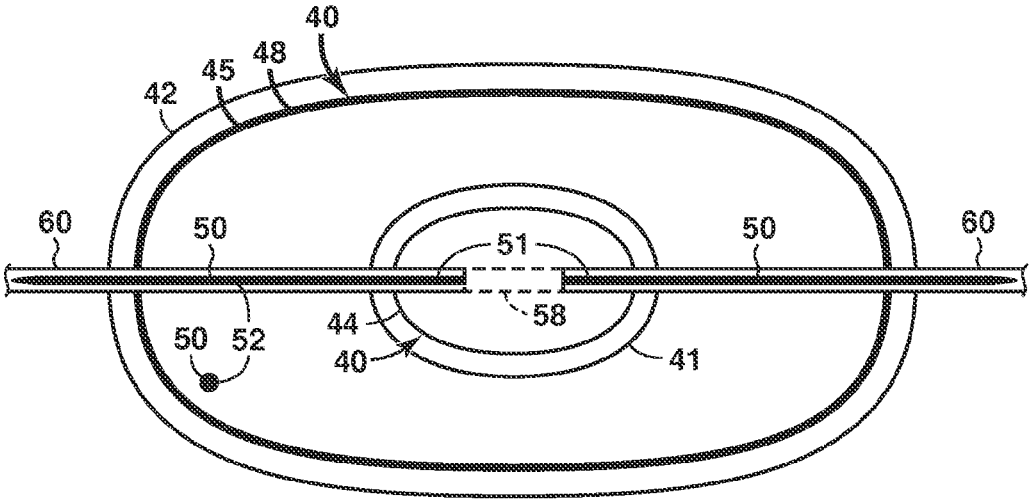
FIG. 7 is a schematic view of an arrangement of electrodes within a subterranean formation.

FIG. 7 illustrates a collinear, spaced-apart first electrode pair 51. When an in situ resistive heating element 40 is electrically powered, the in situ resistive heating element 40 may heat and pyrolyze neighboring subterranean regions. The heating and pyrolyzing may cause an aggregate electrically conductive zone 48 to expand along the elongated dimension of each of the electrodes 50. As the aggregate electrically conductive zone 48 expands, the degree and/or extent of electrical contact between the aggregate electrically conductive zone 48 and at least one of the electrodes 50 may increase. Electrodes 50 may be configured for extended electrical contact when. Electrodes may be configured for extended electrical contact when an electrode is contained within a porous and/or perforated electrode well 60. Electrodes 50 at least partially contained within a natural and/or manmade fracture within the subterranean formation 28 may have extended electrical contact with a portion of the subterranean formation 28.

FIG. 7 illustrates a structure that may be used to generate an initial in situ resistive heating element 40 within the subterranean formation 28. An electrode well 60, or generally the subterranean formation 28, may contain a conventional heating element 58, such as a wellbore heater. In FIG. 7, the conventional heating element 58 is schematically depicted as being located in an electrode well 60 within a horizontal portion of the well, although conventional heating element 58 also may be located within a vertical or other angularly oriented portion of the well. On either side of the conventional heating element 58, within the same electrode well 60, may be an electrode 50, such as one formed from graphite, coke, and/or metal particles packed into the electrode well 60. The conventional heating element 58 and the two electrodes 50 may have independent electrical connections to one or more electrical power sources. Upon operation of the conventional heating element 58, a first region 41 of the subterranean formation 28 may be heated and pyrolyzed to generate a first generation in situ resistive heating element 44. Once the first generation in situ resistive heating element 44 is electrically connected to the first electrode pair 51, the first generation in situ resistive heating element 44 may be electrically powered via the first electrode pair 51.

Figure 8:
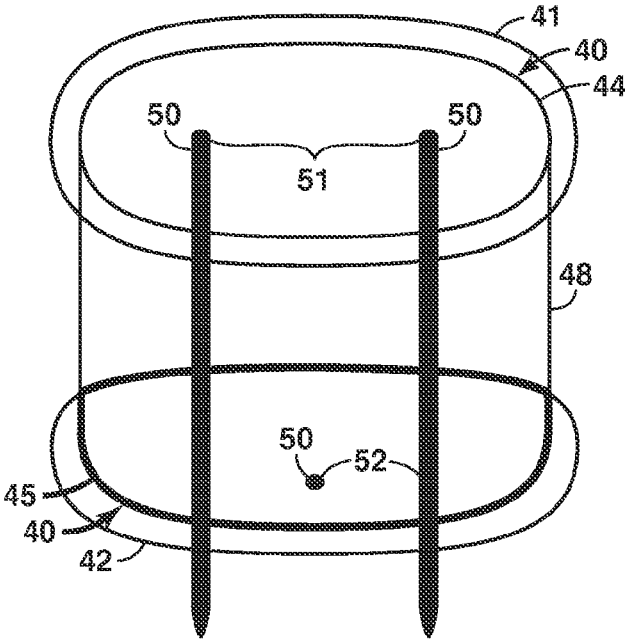
FIG. 8 is a schematic view of an arrangement of electrodes within a subterranean formation.

FIG. 8 illustrates a first electrode pair 51 with a parallel portion, each electrode 50 of the pair configured for extended electrical contact. When an in situ resistive heating element 40 in electrical contact with a parallel pair of electrodes 50 is electrically powered, the in situ resistive heating element 40 may heat and pyrolyze neighboring subterranean regions, causing an aggregate electrically conductive zone 48 to expand along the length of the parallel electrodes, generally perpendicular to the shortest direction between the electrodes 50. As the aggregate electrically conductive zone 48 expands, the degree and/or extent of electrical contact between the aggregate electrically conductive zone 48 and at least one of the electrodes 50 may increase.

Figure 9:
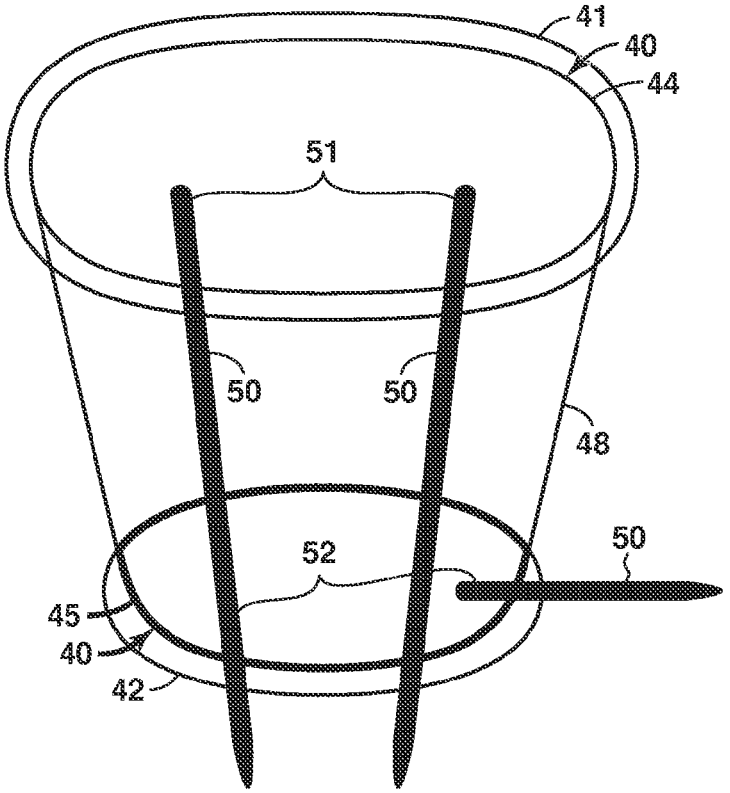
FIG. 9 is a schematic view of an arrangement of electrodes within a subterranean formation.

FIG. 9 illustrates a first electrode pair 51 with a diverging portion, each electrode 50 of the pair configured for extended electrical contact. A portion of a pair of electrodes 50 may be considered diverging if the portion is not generally parallel, e.g., the distance between the electrodes 50 at one end is greater than the distance between the electrodes 50 at another end. For example (as illustrated in FIG. 9), the distance between the first electrode pair 51 within the first generation in situ resistive heating element 44 may be greater than the distance between the same electrodes 50 within the second generation in situ resistive heating element 45.

When an in situ resistive heating element 40 in electrical contact with a diverging pair of electrodes 50 is electrically powered, the in situ resistive heating element 40 may heat and pyrolyze neighboring subterranean regions, causing an aggregate electrically conductive zone 48 to expand along the length of the diverging electrodes. Where the electrodes 50 converge away from the in situ resistive heating element 40 (i.e., the closest approach of the electrodes 50 is not within the in situ resistive heating element 40), the electrical current passing through the expanding aggregate electrically conductive zone 48, and thus the greatest resistive heating, may concentrate away from the in situ resistive heating element 40. Where the electrodes 50 converge towards the in situ resistive heating element 40, the electrical current and the greatest resistive heating may concentrate within the in situ resistive heating element 40. The greater heating at a shorter electrode spacing may increase the speed of the pyrolysis and expansion of the aggregate electrically conductive zone 48.

Figure 10:
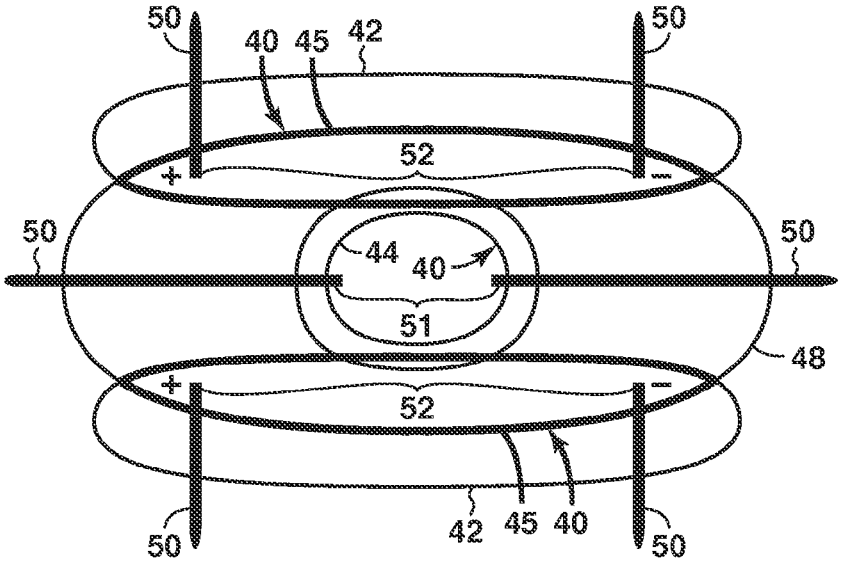
FIG. 10 is a schematic view of an arrangement of electrodes within a subterranean formation.
Figure 11:
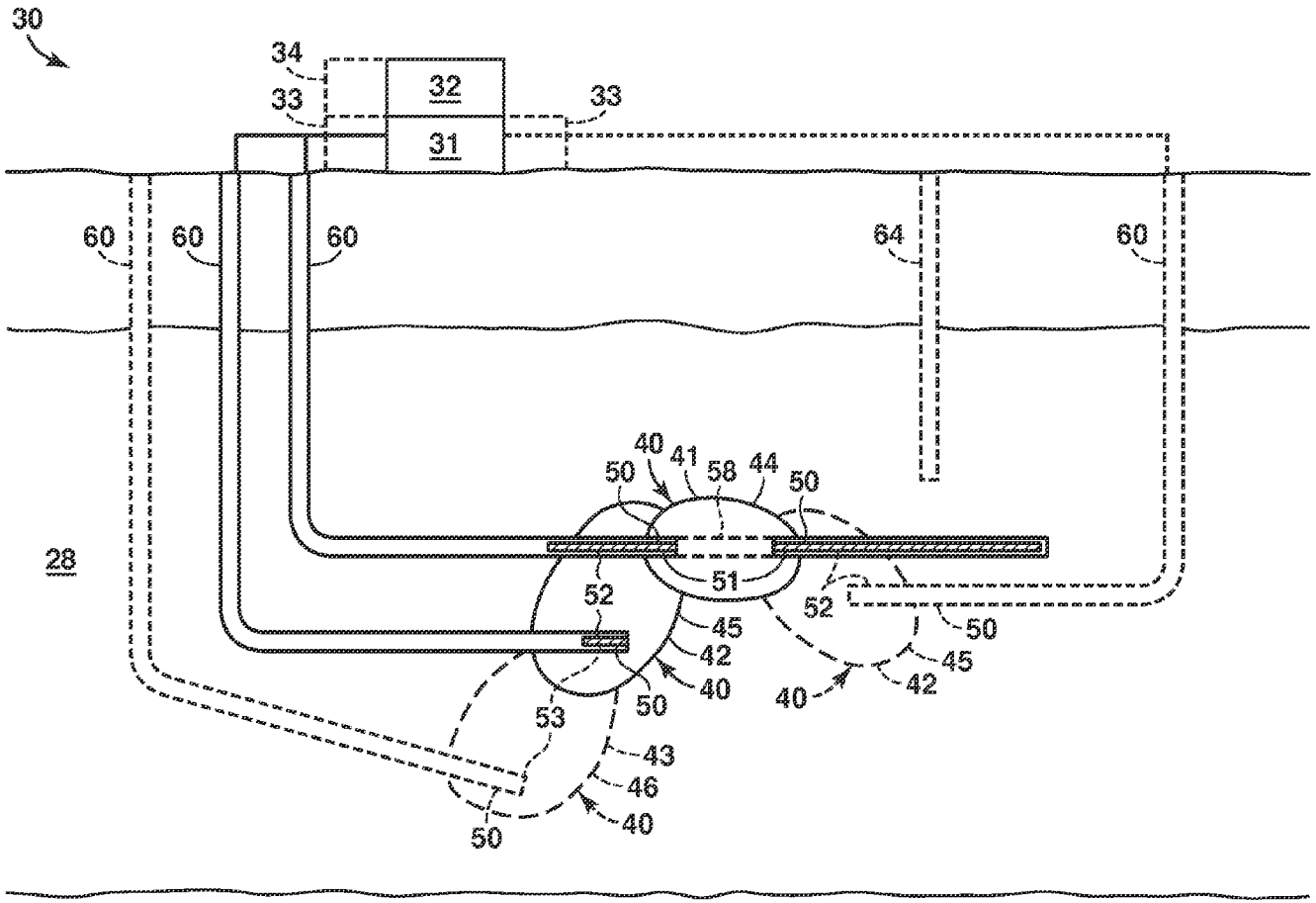
FIG. 11 is a schematic cross-sectional view of a system for in situ resistive heating of organic matter in a subterranean formation.

FIG. 10 illustrates two second generation in situ resistive heating elements 45 at a point when both might be powered simultaneously. The electrical polarity and/or electrical phase of the second pairs of electrodes 52 may be configured to avoid crosstalk between the upper and lower second generation in situ resistive heating elements 45. For example, the left electrode 50 of each second electrode pair 52 may share a similar electrical polarity and/or electrical phase, as indicated by the circled plus signs. Likewise, the right electrode 50 of each second electrode pair 52 may share a similar electrical polarity and/or electrical phase, as indicated by the circled minus signs. If the left electrodes 50 had roughly opposite polarities and/or phases (e.g., 180° out of phase), electrical current would tend to flow predominantly between the left electrodes 50 instead of between either of the two second electrode pairs 52, owing to the shorter electrical path length (and hence likely lesser resistance and higher conductance) between the left electrodes 50 than either second electrode pair 52. For the example of FIG. 10, upper, lower, left, and right refer to the figure on the page, not to the subterranean formation 28.

FIG. 11 schematically depicts examples of systems 30 for pyrolyzing organic matter within a subterranean formation 28. Systems 30 may comprise a first electrode pair 51 electrically connected to a first generation in situ resistive heating element 44 in a first region 41 within the subterranean formation 28. Systems 30 may comprise a second electrode pair 52 electrically connected to a second region 42 within the subterranean formation 28, where the second region 42 is adjacent the first region 41. Systems 30 may comprise at least one second region 42, and optionally a plurality of second regions 42, each adjacent the first region 41 and each electrically connected to a distinct second electrode pair 52. Further, each second region 42 may comprise a second generation in situ resistive heating element 45. Systems 30 may comprise at least one third region 43, each adjacent at least one second region 42 and each electrically connected to a distinct third electrode pair 53. Further, each third region 43 may comprise a third generation in situ resistive heating element 46.

Each electrode 50 may be contained at least partially within an electrode well 60. An electrode 50 may extend into the subterranean formation 28, outside of an electrode well 60, for example, through a natural and/or manmade fracture. An electrode well 60 may contain one or more electrodes 50 and other active components, such as a conventional heating element 58.

Systems 30 may comprise an electrical power source 31 electrically connected through the first electrode pair 51 to the first generation in situ resistive heating element 44. Further, systems 30 may comprise an electrical power switch 33 that electrically connects (potentially sequentially or simultaneously) the electrical power source 31 to the first electrode pair 51 and the second electrode pair 52.

Systems 30 may comprise a sensor 32 to monitor a monitored parameter relating to at least one of the subterranean formation 28 and the organic matter in the subterranean formation 28. The monitored parameter may include geophysical data relating to a shape, an extent, a volume, a composition, a density, a porosity, a permeability, an electrical conductivity, an electrical property, a temperature, and/or a pressure of the subterranean formation 28 and/or a region of the subterranean formation 28. The monitored parameter may relate to the production of mobile components within the subterranean formation 28 (e.g., hydrocarbon production). The monitored parameter may relate to the electrical power applied to at least a portion of the subterranean formation 28. For example, the monitored parameter may include the at least one of the duration of applied electrical power, the magnitude of electrical power applied, and the magnitude of electrical current transmitted. The magnitude may include the average value, the peak value, and/or the integrated total value.

Systems 30 may comprise a production well 64, from which mobile components (e.g., hydrocarbon fluids) are extracted or otherwise removed from at least one of the first region 41, the second region(s) 42, the third region(s) 43, and/or the subterranean formation 28. For example, the production well 64 may be fluidically connected to at least one of the first region 41, the second region(s) 42, the third region(s) 43, and/or the subterranean formation 28.

Systems 30 may comprise a controller 34 that is programmed or otherwise configured to control, or regulate, at least a portion of the operation of system 30. As examples, controller 34 may control the electrical power source 31, record the sensor 32 output, and/or regulate the system 30, the first generation in situ resistive heating element 44, the second generation in situ resistive heating element 45, and/or the third generation in situ resistive heating element 46. The controller 34 may be programmed or otherwise configured to control system 30 according to any of the methods described herein.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, the order of the blocks may vary from the illustrated order in the flow diagram, including with two or more of the blocks (or steps) occurring in a different order and/or concurrently.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numeral ranges provided. Accordingly, these terms should be interpreted as indicating that insubstantial or inconsequential modifications or alterations of the subject matter described and are considered to be within the scope of the disclosure.

INDUSTRIAL APPLICABILITY

The systems and methods disclosed herein are applicable to the oil and gas industry.

The subject matter of the disclosure includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are novel and non-obvious. Other combinations and subcombinations of features, functions, elements and/or properties may be claimed through amendment of the present claims or presentation of new claims in this or a related application. Such amended or new claims, whether different, broader, narrower, or equal in scope to the original claims, are also regarded as included within the subject matter of the present disclosure.

The invention claimed is:

1. A method for pyrolyzing organic matter in a subterranean formation, the method comprising:

powering a first generation in situ resistive heating element within an aggregate electrically conductive zone at least partially in a first region of the subterranean formation by transmitting an electrical current between a first electrode and a second electrode of a first electrode pair in electrical contact with the first generation in situ resistive heating element to pyrolyze a second region of the subterranean formation, adjacent the first region, to expand the aggregate electrically conductive zone into the second region, wherein the expanding creates a second generation in situ resistive heating element within the second region; and powering the second generation in situ resistive heating element by transmitting an electrical current between a first and a second electrode of a second electrode pair in electrical contact with the second generation in situ resistive heating element to generate heat with the second generation in situ resistive heating element within the second region, wherein the first electrode of the second electrode pair extends within the second region, and the second electrode of the second electrode pair is the first electrode of the first electrode pair or the second electrode of the first electrode pair.

2. The method of claim 1, further comprising pyrolyzing the first region of the subterranean formation to create the first generation in situ resistive heating element within the first region.

3. The method of claim 2, further comprising placing in the subterranean formation at least one electrode well prior to creating the first generation in situ resistive heating element, wherein the electrode well is configured to contain at least one electrode of the first electrode pair or the second electrode pair.

4. The method of claim 3, wherein the placing in the subterranean formation at least one electrode well includes placing two electrodes within the electrode well, and wherein the electrode well includes a wellbore heater between the two electrodes.

5. The method of claim 2, further comprising placing at least one electrode of the second electrode pair into electrical contact with the second region prior to creating the first generation in situ resistive heating element.

6. The method of claim 2, wherein the pyrolyzing the first region includes increasing an average electrical conductivity of the first region.

7. The method of claim 2, wherein the pyrolyzing the first region results in an average electrical conductivity of the first region of at least $10^{-4}$ S/m.

8. The method of claim 1, further comprising placing at least one electrode of the second electrode pair into electrical contact with the second region prior to creating the second generation in situ resistive heating element.

9. The method of claim 1, further comprising placing in the subterranean formation at least one electrode well prior to creating the second generation in situ resistive heating element, wherein the electrode well is configured to contain at least one electrode of the first electrode pair or the second electrode pair.

10. The method of claim 1, wherein the powering the first generation in situ resistive heating element includes expanding the aggregate electrically conductive zone into electrical contact with at least one electrode of the second electrode pair.

11. The method of claim 1, wherein the powering the first generation in situ resistive heating element includes establishing electrical contact between the aggregate electrically conductive zone and at least one electrode of the second electrode pair.

12. The method of claim 1, wherein the powering the first generation in situ resistive heating element includes increasing a degree of electrical contact between the aggregate electrically conductive zone and at least one electrode of the second electrode pair.

13. The method of claim 1, wherein at least one electrode of the first electrode pair includes an elongated contact portion, wherein the powering the first generation in situ resistive heating element includes expanding the aggregate electrically conductive zone along a length of the elongated contact portion.

14. The method of claim 1, further comprising ceasing the powering the first generation in situ resistive heating element before the powering the second generation in situ resistive heating element.

15. The method of claim 1, further comprising ceasing the powering the first generation in situ resistive heating element during the powering the second generation in situ resistive heating element.

16. The method of claim 1, wherein the powering the first generation in situ resistive heating element includes regulating expansion of the aggregate electrically conductive zone by controlling at least one of a duration of the powering, a magnitude of electrical power, and a magnitude of electrical current.

17. The method of claim 1, wherein the powering the second generation in situ resistive heating element includes regulating expansion of the aggregate electrically conductive zone by controlling at least one of a duration of the powering, a magnitude of electrical power, and a magnitude of electrical current.

18. The method of claim 1, wherein the powering the first generation in situ resistive heating element includes pyrolyzing a plurality of second regions of the subterranean formation, each adjacent the first region, to create a second generation in situ resistive heating element within each second region, wherein the pyrolyzing the plurality of second regions expands the aggregate electrically conductive zone into each of the second regions; and wherein the powering the second generation in situ resistive heating element includes powering at least two second generation in situ resistive heating elements by transmitting an electrical current between at least two second electrode pairs, each second electrode pair in electrical contact with a distinct second generation in situ resistive heating element, to heat the second regions.

19. The method of claim 18, wherein the pyrolyzing the plurality of second regions includes expanding the aggregate electrically conductive zone into electrical contact with at least one electrode of each second electrode pair.

20. The method of claim 18, wherein the pyrolyzing the plurality of second regions includes establishing electrical contact between the aggregate electrically conductive zone and at least one electrode of each second electrode pair.

21. The method of claim 18, wherein the pyrolyzing the plurality of second regions includes increasing a degree of electrical contact between the aggregate electrically conductive zone and at least one electrode of each second electrode pair.

22. The method of claim 1, further comprising determining a desired geometry of the aggregate electrically conductive zone prior to the powering the first generation in situ resistive heating element, at least partially based on data relating to at least one of the subterranean formation and an organic matter in the subterranean formation.

23. The method of claim 1, further comprising determining a desired geometry of the aggregate electrically conductive zone prior to the powering the first generation in situ resistive heating element, at least partially based on data relating to an organic matter in the subterranean formation.

24. The method of claim 1, further comprising monitoring a parameter while powering the first generation in situ resistive heating element, wherein the parameter includes geophysical data relating to at least one of a shape, a volume, a composition, a density, a porosity, a permeability, an electrical conductivity, an electrical property, a temperature, and a pressure of at least a portion of the subterranean formation; and further wherein the method includes ceasing powering the first generation in situ resistive heating element at least partially based on the parameter.

25. The method of claim 1, further comprising monitoring a parameter while powering the first generation in situ resistive heating element, wherein the parameter includes at least one of a duration of applied electrical power, a magnitude of electrical power applied, and a magnitude of electrical current transmitted, and further wherein the method includes ceasing powering the first generation in situ resistive heating element at least partially based on the parameter.

26. The method of claim 1, wherein the powering the first generation in situ resistive heating element and the powering the second generation in situ resistive heating element include producing at least one of liquid hydrocarbons, gaseous hydrocarbons, shale oil, bitumen, pyrobitumen, bituminous coal, and coke.

27. The method of claim 1, wherein the pyrolyzing the second region includes increasing an average electrical conductivity of the second region.

28. The method of claim 1, wherein the pyrolyzing the second region results in an average electrical conductivity of the second region of at least $10^{-4}$ S/m.

29. The method of claim 1, wherein the pyrolyzing the second region includes decreasing an average electrical conductivity of the first generation in situ resistive heating element.

30. A method for pyrolyzing organic matter in a subterranean formation, the method comprising:

transmitting a first electrical current in the subterranean formation between a first electrode and a second electrode of a first electrode pair in electrical contact with a first generation in situ resistive heating element;

powering a first generation in situ resistive heating element, within an aggregate electrically conductive zone at least partially in a first region of the subterranean formation, with the first electrical current;

expanding the aggregate electrically conductive zone into a second region, adjacent the first region of the subterranean formation, with the first electrical current, wherein the expanding creates a second generation in situ resistive heating element within the second region;

transmitting a second electrical current in the subterranean formation between a first electrode and a second electrode of a second electrode pair in electrical contact with the second generation in situ resistive heating element;

powering the second generation in situ resistive heating element with the second electrical current; and generating heat with the second generation in situ resistive heating element within the second region, wherein the first electrode of the second electrode pair extends within the second region, and the second electrode of the second electrode pair is the first electrode of the first electrode pair or the second electrode of the first electrode pair.

* * * * *